US005512993A

United States Patent [19]

Endo et al.

[11] Patent Number: 5,512,993

[45] Date of Patent: Apr. 30, 1996

[54] IMAGE HEATING DEVICE CAPABLE OF CONTROLLING ACTIVATION OF PLURAL HEATERS

[75] Inventors: Saijiro Endo, Tokyo; Yoshikuni Toyama; Hisaaki Senba, both of Yokohama; Hisatsugu Tahara, Kawasaki; Hiroshi Matsumoto, Kawasaki; Keisuke Hasegawa, Kawasaki, all of Japan

[73] Assignee: Canon Kabushiki Kaisha, Tokyo, Japan

[21] Appl. No.: 331,873

[22] Filed: Nov. 1, 1994

Related U.S. Application Data

[63] Continuation of Ser. No. 37,418, Mar. 26, 1993, abandoned.

[30] Foreign Application Priority Data

| | | | |
|---|---|---|---|
| Mar. 31, 1992 | [JP] | Japan | 4-104016 |
| Jun. 26, 1992 | [JP] | Japan | 4-191375 |
| Jun. 26, 1992 | [JP] | Japan | 4-191376 |
| Jun. 30, 1992 | [JP] | Japan | 4-173267 |
| Jun. 30, 1992 | [JP] | Japan | 4-173268 |
| Jul. 7, 1992 | [JP] | Japan | 4-179894 |

[51] Int. Cl.[6] ..... G03G 15/20

[52] U.S. Cl. ..... 355/285; 219/216; 432/60

[58] Field of Search ..... 355/285, 289, 355/290; 432/60; 219/216, 388

[56] References Cited

U.S. PATENT DOCUMENTS

| | | | |
|---|---|---|---|
| 4,585,325 | 4/1986 | Euler | 219/216 X |
| 4,825,242 | 4/1989 | Elter . | |
| 5,041,718 | 8/1991 | d'Hondt et al. | 219/216 X |
| 5,171,969 | 12/1992 | Nishimura et al. | 219/216 |
| 5,204,723 | 4/1993 | Hanada et al. | 355/285 |

FOREIGN PATENT DOCUMENTS

| | | | |
|---|---|---|---|
| 0121772A1 | 10/1984 | European Pat. Off. . | |
| 0370519A2 | 5/1990 | European Pat. Off. . | |
| 54-83444 | 7/1979 | Japan . | |
| 57-158866 | 9/1982 | Japan . | |
| 58-130368 | 8/1983 | Japan . | |
| 60-87377 | 5/1985 | Japan . | |
| 1-20585 | 1/1989 | Japan | 355/285 |
| 3-198056 | 8/1991 | Japan | 355/285 |
| 2249525 | 5/1992 | United Kingdom . | |

*Primary Examiner*—R. L. Moses

*Attorney, Agent, or Firm*—Fitzpatrick, Cella, Harper & Scinto

[57] ABSTRACT

Disclosed is an image heating device for a fixing device in image forming apparatus. The image heating device is provided with two heaters and an image fixing roller. The image fixing roller is heated by the two heaters, one having the heat distribution in the center and the other having the heat distribution in the end portion of the fixing roller. The heaters are alternately energized so that the power requirement is maintained limited. The energization time ratio of the heaters is suitably varied according to the sheet size in order to compensate the temperature loss in the end portions when the heating is conducted in the central portion only, or to reduce the temperature rise in the end portions, encountered when narrow sheets are consecutively passed, thereby preventing various drawbacks resulting from uneven temperature distribution on the fixing roller.

16 Claims, 34 Drawing Sheets

CHARACTERISTIC OF HEAT DISTRIBUTION FOR MAIN HEATER

CHARACTERISTIC OF HEAT DISTRIBUTION FOR SUB-HEATER

IMAGE HEATING DEVICE CAPABLE OF CONTROLLING ACTIVATION OF PLURAL HEATERS

This application is a continuation of application Ser. No. 08/037,418, filed Mar. 26, 1993, now abandoned.

BACKGROUND OF THE INVENTION

1. Field of the Invention

The present invention relates to an image heating device for heating an image on a recording material, and more particularly to an image heating device adapted for use as a fixing device in an image forming apparatus.

2. Related Background Art

For heating an image on a recording material there is widely employed a system of contacting a recording material with a heating member maintained at a predetermined temperature, as exemplified by the heated roller system.

Such heating system requires a certain warm-up time until the heating member reaches the predetermined temperature after the start of power supply thereto.

For reducing the warm-up time, there are generally two methods, a first method being to increase the power of the heater constituting the heat-generating member, while a second method being to reduce the thickness of the heating roller in order to reduce the heat capacity thereof.

However, the first method is associated with a drawback of lack in electric power in the entire image forming apparatus, since, even though an enough electric power can be supplied to the heater at the warm-up stage, the electric power has to be supplied to other units of the apparatus in addition to the fixing unit upon operation of the ordinary image forming. The second method shortens the warm-up time, but is associated with the following drawback. In an image forming apparatus available for recording sheets (as recording material) of various widths, the heat amount distribution of the heater is designed for the recording sheet of the largest width. Consequently, if the recording sheets of narrower width are made to pass in succession, the end portions of the heating roller becomes very hot, due to the lack of heat dissipation to the recording sheet, in comparison with the central portion of the roller where the recording sheet passes, thus eventually giving rise a failure of the device in some cases. This is the reason that it is difficult to dissipate heat in the longitudinal direction of the roller due to the reduced thickness of the roller.

There is also another method of adopting two heaters, and energizing both in the warm-up stage while energizing only one in the ordinary image forming operation, but such configuration is still associated with the above-mentioned drawback of temperature rise in the end portions of the roller when the narrow recording sheets are used in succession.

SUMMARY OF THE INVENTION

An object of the present invention is to provide an image heating device capable of reducing the heat capacity of the heating member and reducing the warm-up time.

Another object of the present invention is to provide an image heating device capable of preventing the temperature rise of the heating member in portions where the sheets do not pass.

Still another object of the present invention is to provide an image heating device comprising a heating member provided with a first heater and a second heater of a heat distribution different from that of the first heater, a back-up member forming a nip with the heating member, and electrifying control means for effecting time-shared control of electrifying to the first and second heaters.

Still other objects of the present invention, and the features thereof, will become fully apparent from the following description.

DESCRIPTION OF THE PREFERRED EMBODIMENTS

In the following an embodiment of the present invention will be described with reference to FIGS. 1 to 5. At first, for the purpose of comparison with the present embodiment, there is supposed a single heater 1 as shown in FIG. 5, which is assumed to have a power and a length capable of satisfactorily fixing the toner image on a recording sheet of a maximum size (hereinafter called "full size") employed in the ordinary copying machine. Namely, the heater 1 has the heat amount distribution over the entire area of a length L [mm] corresponding to the full size, with an output power $Q_0$ [W], so that the output per unit length is $Q_0/L$ [W/mm] in this case. The heater 1 is controlled by control means (not shown) so as to intermittently be turned on and off according to a signal from temperature detector means (not shown) such as a thermistor, thereby maintaining the surface temperature of a fixing roller within a given temperature range. The sequence of electrifying is shown in FIG. 5. The electrifying of the heater 1 is conducted with a cycle time S [sec], in which the heater 1 is energized (electrified) for a period T [sec] and deactivated for a period (S-T) [sec] in intermittently. Consequently, the heat amount supplied per unit length of the heater 1 in cycle time S [sec] is $q_0$ [W·sec/mm]=($Q_0$ [W]/L [mm])×t [sec]. Namely, the heat amount $q_0$ is required for fixing the toner image on the recording sheet of full size.

Figure 1:
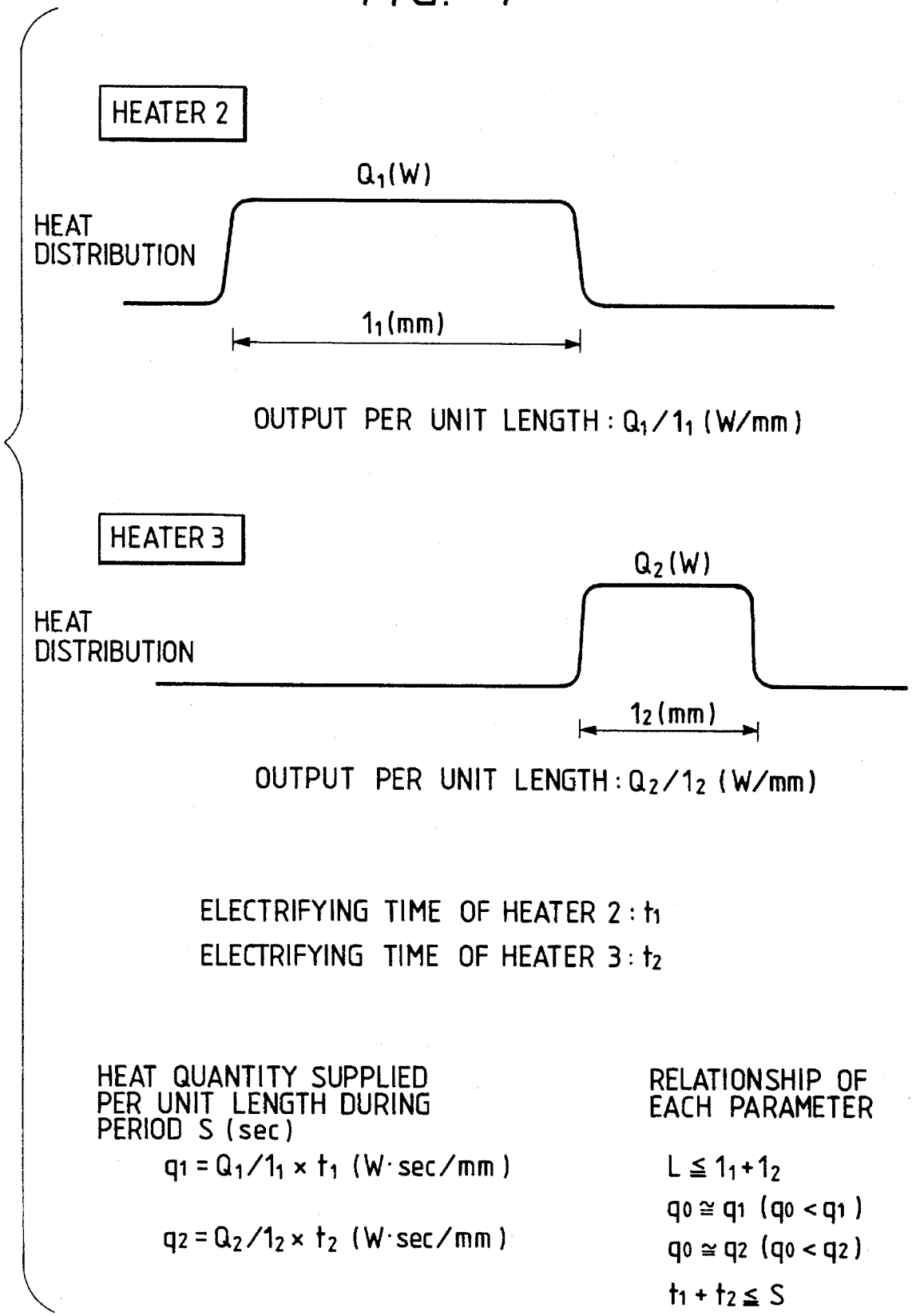
FIG. 1 is a chart showing the distribution of heat generation of heaters in an embodiment of the present invention.

The present embodiment employs two heaters 2, 3 of heat distributions as shown in FIG. 1. The heater 2 has the distribution only in a length $l_1$ [mm] corresponding to a recording sheet of a narrower width, while the heater 3 has the distribution mainly in a narrower area $l_2$ [mm] outside the recording sheet. Assuming that the heaters 2, 3 have outputs $Q_1$, $Q_2$ [W], respectively, the output per unit length of the heater 2 is $Q_1/l_1$ [W/mm] while that of the heater 3 is $Q_2/l_2$ [W/mm]. Also in this embodiment there is conducted intermittent control with a cycle time S [sec] as explained above, with total electrifying times $t_1$, $t_2$ [sec] for the heaters 2, 3 in the cycle time S, so that the heat amounts supplied per unit length within the cycle time S are $q_1$ [W·sec/mm]= ($Q_1$ [W]/$l_1$[mm])×$t_1$ [sec] for the heater 2 and $q_2$=($Q_2/l_2$)×$t_2$ for the heater 3.

Since the satisfactory fixation of the toner image on the recording sheet of full size requires a heat amount per unit length of $q_0$[W·sec/mm] within the cycle time S [sec] as mentioned above, the heat amounts $q_1$, $q_2$ [W·sec/mm] from the heaters 2, 3 have to be at least equal to the heat amount $q_0$. Also if the sum of the total electrifying times $t_1$, $t_2$ of the heaters 2, 3 exceeds the cycle time S [sec], the supply of the electric power to the image forming apparatus becomes deficient since the heaters 2, 3 have to be simultaneously energized for a certain period. Consequently the control has to be executed so as to satisfy a condition $t_1$ [sec]+$t_2$ [sec]≦S [sec]. Also there is required a relationship L [mm]≦$l_1$ [mm]+$l_2$ [m/n] in order that heat does not lack in any part when the heat distributions of the heaters 2 and 3 are superposed. In consideration of these conditions, the total electrifying times $t_1$, $t_2$ of the heaters 2, 3 within the cycle time S [sec] are determined as shown in FIG. 2.

Figure 2:
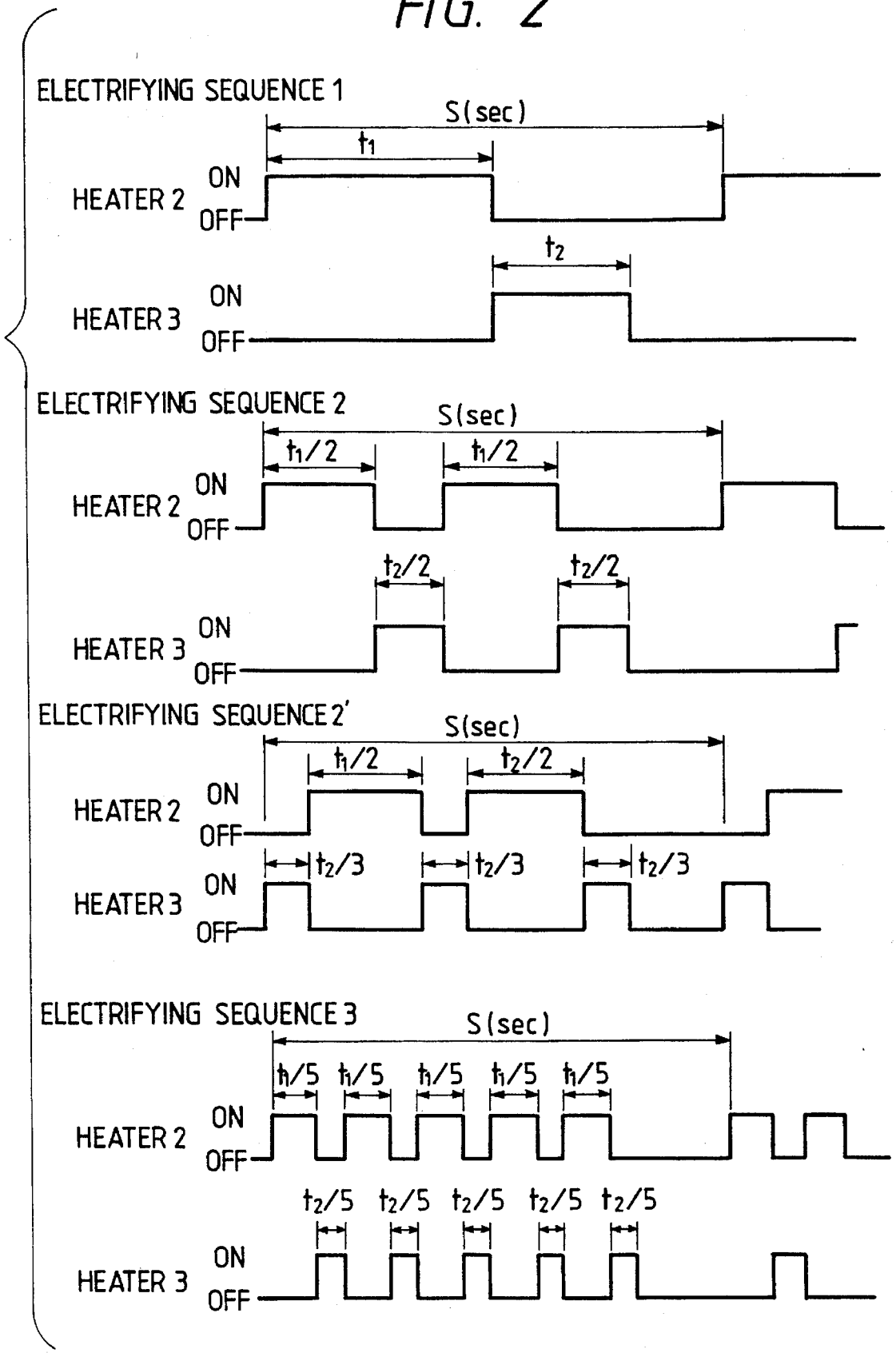
FIG. 2 is a chart showing the timing of energization of the heaters shown in FIG. 1.

Now reference is made to FIG. 2 for explaining the electrifying sequence for the heaters 2, 3. In a sequence 1, each of the heaters 2, 3 is energized only once within the cycle time S [sec]. If the thickness of core metal of the fixing roller is relatively large, such sequence can be employed because of a large heat capacity. In a sequence 2, each of the heaters 2, 3 is energized twice within the cycle time S, while in a sequence 2', the heater 2 is energized twice and the heater 3 is energized three times. Also in a sequence 3, each of the heaters is energized five times. In this manner, various controls are possible in this embodiment.

Figure 3:
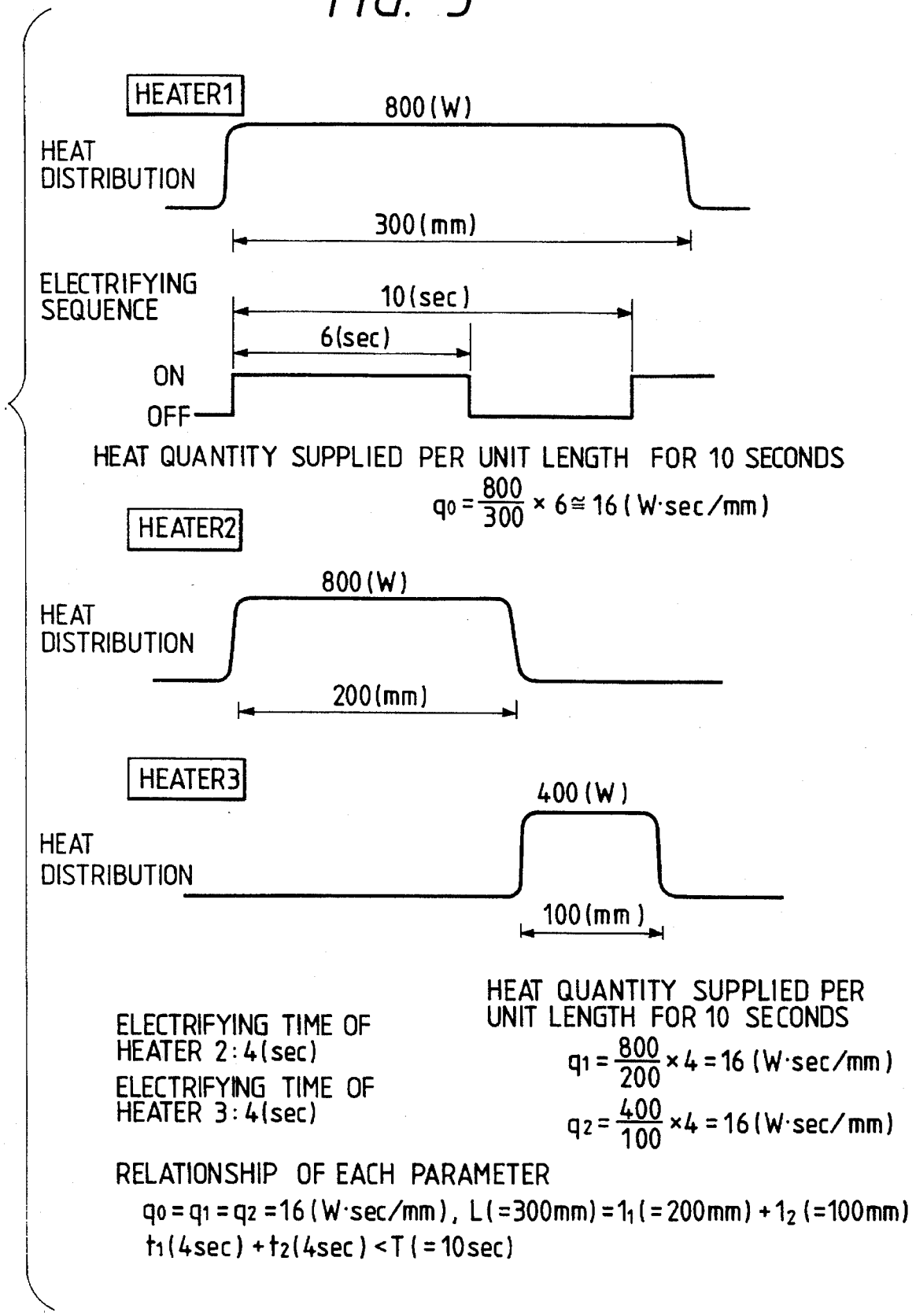
FIG. 3 is a chart showing the generated heat distribution and the timing of electrifying in case of a heater shown in FIG. 5, with a power of 800 W and a length of 300 mm, and also showing the generated heat distribution in case of heaters, shown in FIG. 1, respectively with a power of 800 W and a length of 200 mm and a power of 400 W and a length of 100 mm.

In the following the present embodiment will be further clarified by numerical examples of the parameters. It is assumed, as shown in FIG. 3, that a heater 1 of 800 W is required for satisfactorily fixing the toner image on the recording sheet of full size. For maintaining the surface temperature of the fixing roller within a predetermined temperature range, there is assumed an electrifying sequence of activation of 6 seconds and deactivation of 4 seconds within a cycle time of 10 seconds. In this case the heat amount supplied per unit length within the cycle time of 10 seconds is $q_0$=(800 [W]/300 [mm])×6 [sec] ≅16 [W·sec/mm], which corresponds to the heat amount per unit length required for fixing the toner image on the recording sheet of full size, within the cycle time S of 10 seconds.

On the other hand, in the present embodiment, the heaters 2, 3 respectively have the heat amount distributions of 800 [W]/200 [mm] and 400 [W]/100 [mm].

With the total electrifying times of 4 [sec] for the heater 2 and 4 [sec] for the heater 3 within the cycle time of 10 seconds, the heat amounts supplied by the heaters 2, 3 per unit length within the cycle time are, respectively, $q_1$=800 [W]/200 [mm]×4 [sec]=16 [W·sec/mm] and $q_2$=400/100×4=16 [W·sec/mm], which are substantially equal to the heat amount 16 W·sec/mm required by a single heater.

Also the sum of the total electrifying time of 4 seconds for the heater 2 and that of 4 seconds for the heater 3 is 8 seconds, which is smaller than the cycle time of 10 seconds, so that the heater 2 of 800 W and the heater 3 of 400 W are not energized simultaneously. Consequently, in the present embodiment, the heaters 2, 3 can be energized in the course of a copying operation with an electric power available after deducting of the power required for the optical (illuminating) system or for the main motor.

If the heaters 2, 3 are to be energized simultaneously, the fixing device will require an electric power of 800+400=1200 W, and other units involved in the copying operation will not be powered. Since the electric power ordinarily available, for example, in the Japanese standards is limited to 15 [A]×100 [V]=1500 [W] , there will only be available an electric power of 1500–1200=300 W.

Figure 4:
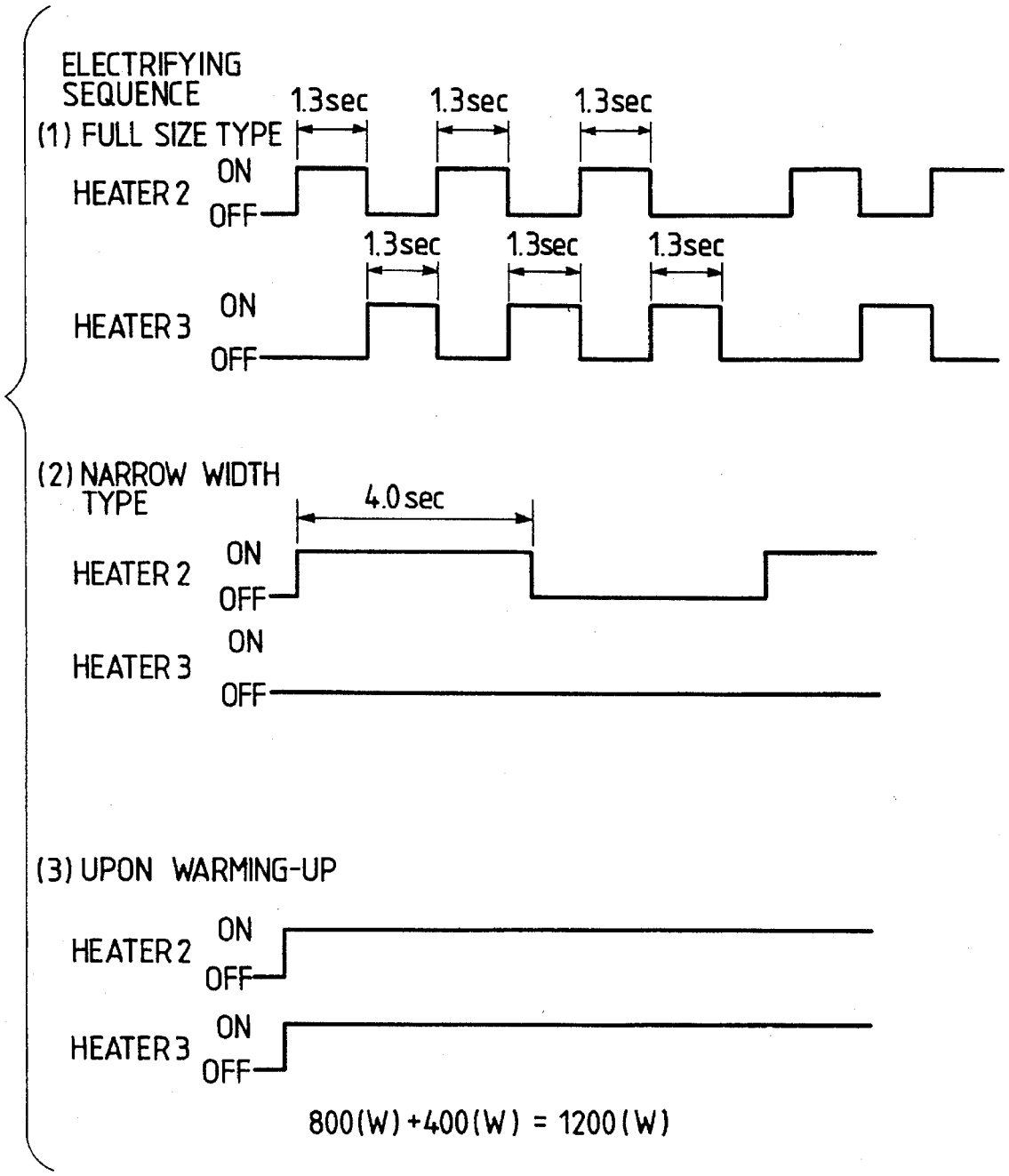
FIG. 4 is a chart showing the timing of electrifying in case of the heaters shown in FIG. 1, respectively with a power of 800 W and a length of 200 mm and a power of 400 W and a length of 100 mm.
Figure 5:
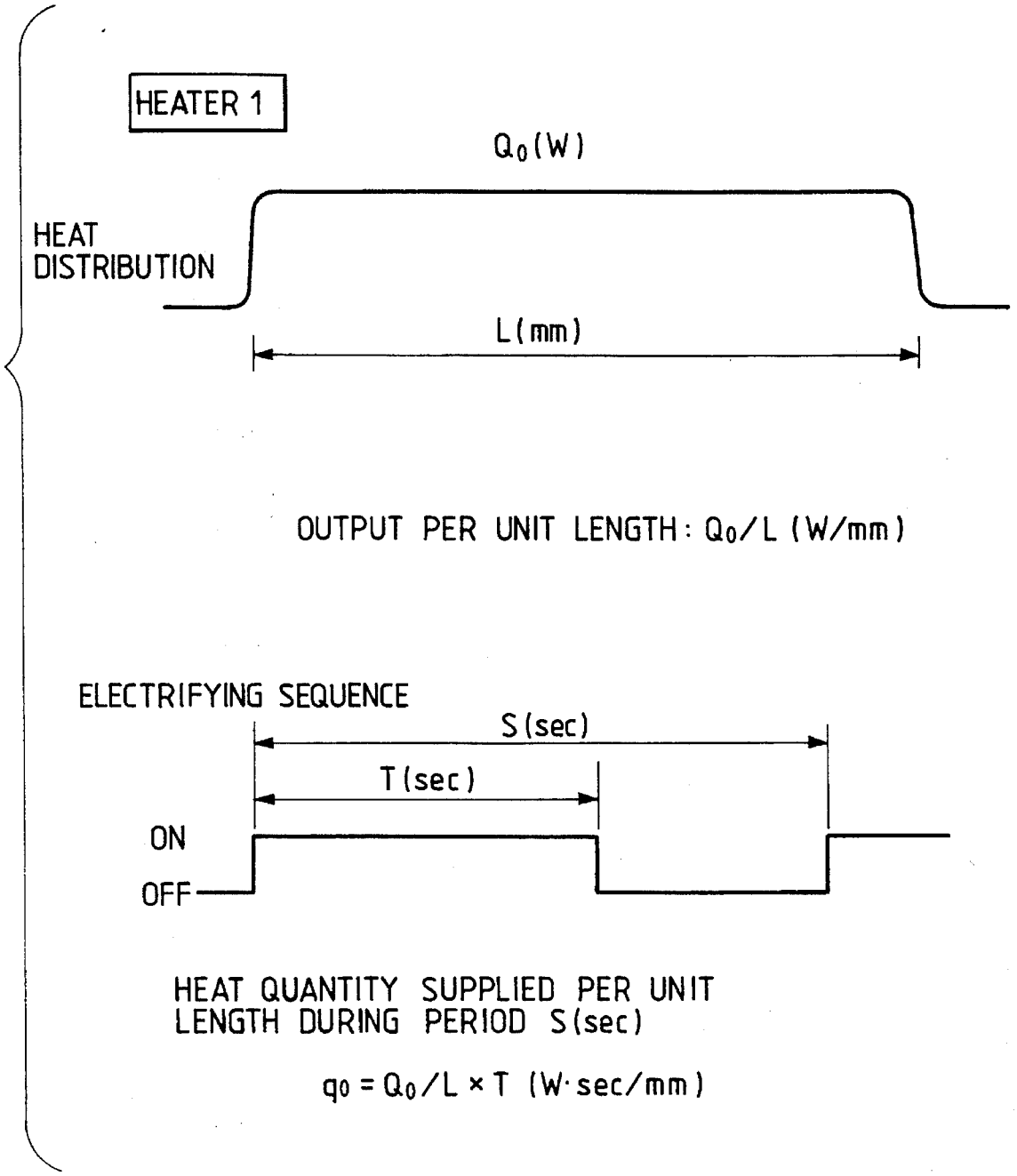
FIG. 5 is a chart showing the generated heat distribution and the timing of electrifying of a single heat-generating member capable of satisfactorily fixing the recording sheet of maximum size, shown for the purpose of comparison with the embodiment of the present invention.

Now reference is made to FIG. 4 for explaining examples of the electrifying sequence for the above-mentioned two heaters 2, 3. In case of fixing a recording sheet of full size, covering the entire length of the fixing roller, the heater 2 is energized three times with an electrifying time of 1.3 seconds each, within the cycle time as shown in FIG. 4. The heater 3 is energized three times with an electrifying time of 1.3 seconds each during the deactivation periods of the heater 2.

Such sequence enables the heaters 2, 3 to provide a heat amount equivalent to that of 16 W·sec/mm provided by a single heater over the entire length within 10 seconds, thus satisfying the requirement of fixation of the toner image on the full-sized sheet.

On the other hand, in case of fixing a narrower recording sheet, the heater 2 alone is energized while the heater 3 is continuously deactivated as shown in FIG. 4, whereby prevented is the temperature rise in the end portion (where the sheet does not pass) of the fixing roller, conventionally encountered when the narrower recording sheets are consecutively fixed.

In the warm-up stage, since the optical system, main motor and the like in the main body of the apparatus are still stopped, a power of 800+ 400=1200 W can be supplied to the fixing device, so that the fixing roller can be heated with both of the heaters 2 and 3. Consequently the waiting time can be significantly shortened, in comparison with the conventional case of warming up with a single heater of 800 W.

Figure 6:
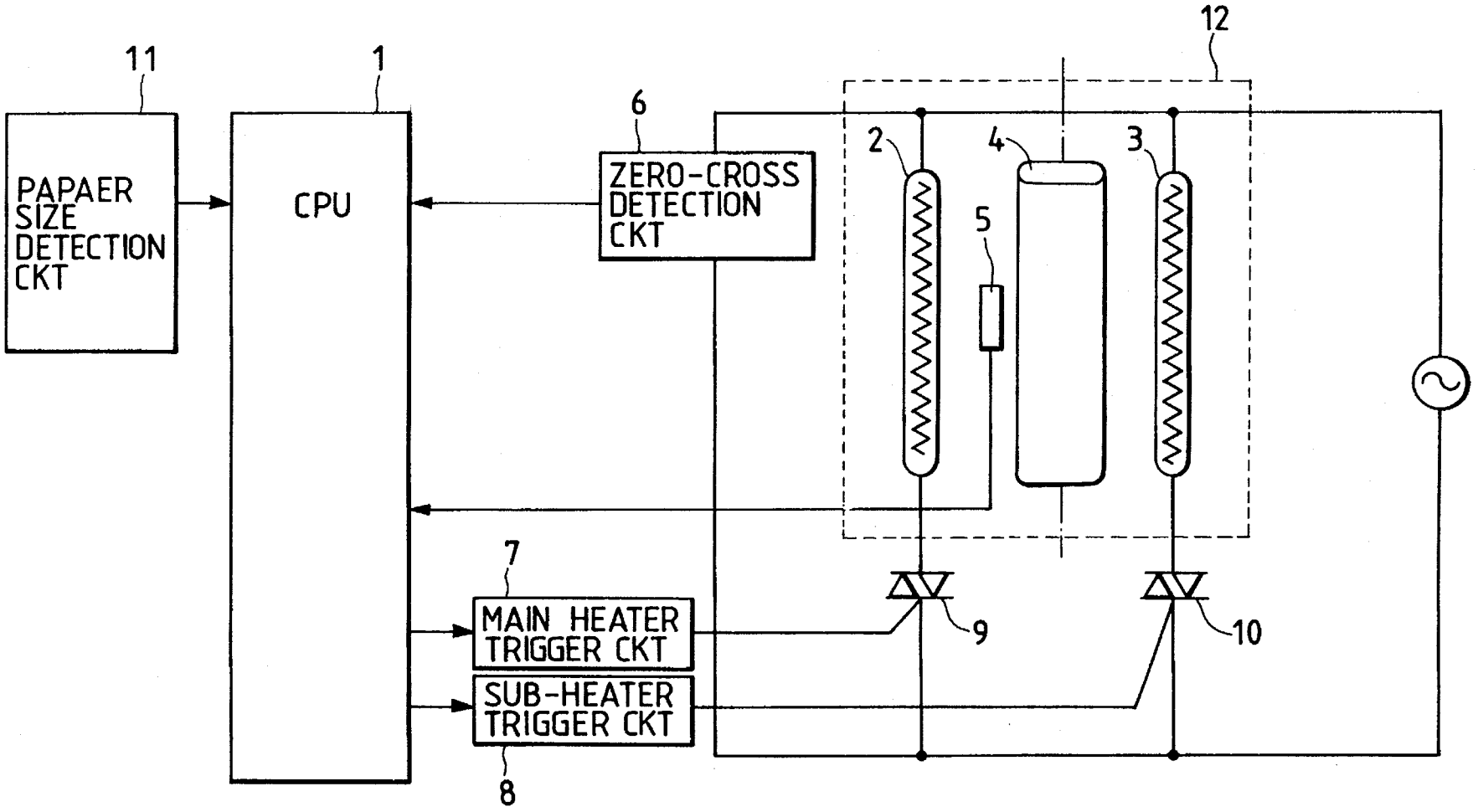
FIG. 6 is a block diagram of another embodiment of the device of the present invention.

In the following there will be explained another embodiment of the present invention, of which block diagram is shown in FIG. 6.

A CPU 1 serves as timing control means for the image forming operation of the image forming apparatus in which the device of the present embodiment is adopted and for the temperature control of a fixing roller 4 in a fixing device 2. A main (first) heater 2 and a sub (second) heater 3 each for heating the fixing roller 4 with different heat distribution, are energized by entering on/off signals from the CPU into trigger circuits 7, 8 thereby activating triacs 9, 10.

On the fixing roller 4, a thermistor 5 is maintained in contact, for detecting the surface temperature of the roller. The temperature detected by the thermistor 5 is supplied as an analog voltage signal to an A/D conversion port of the CPU 1, which effects temperature control based on thus detected temperature.

A sheet size detection means 11 detects the size of the recording sheet, for example by the combination of signals entered from plural push switches. In response to the signals, the CPU 1 switches the control timings for the main heater 2 and the sub heater 3.

A zero-cross detection circuit 6 for the AC input signals to the main heater 2 and the sub heater 3 provides output pulses to an input port or an interruption port of the CPU 1, which counts thus entered pulses and regulates the control timings for the main heater 2 and the sub heater 3 according to the obtained count.

In the following there will be explained, with reference to FIGS. 7 and 8, the heat distribution characteristics of the fixing heaters of the present embodiment.

It is assumed that the recording sheet is transported at the center as the basis of reference, regardless of the sheet size.

Figure 7:
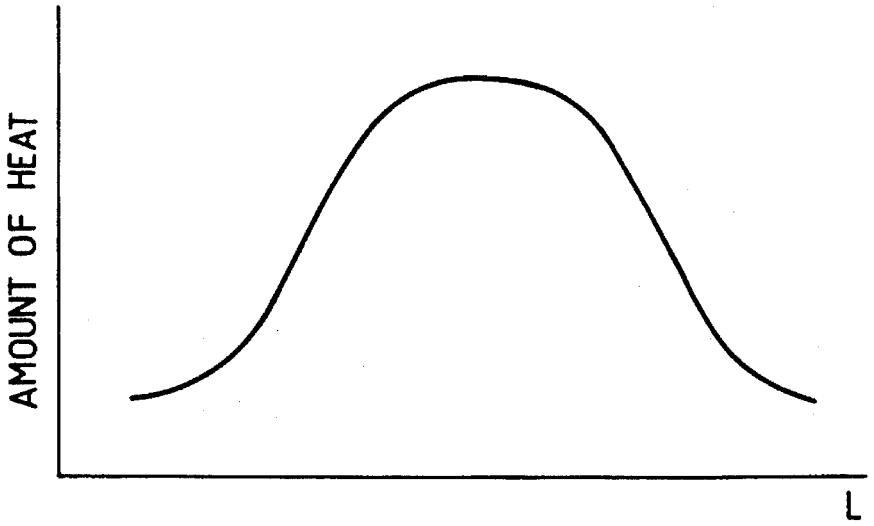
FIG. 7 is a chart showing the heat distribution characteristic of a main heater shown in FIG. 6.
Figure 8:
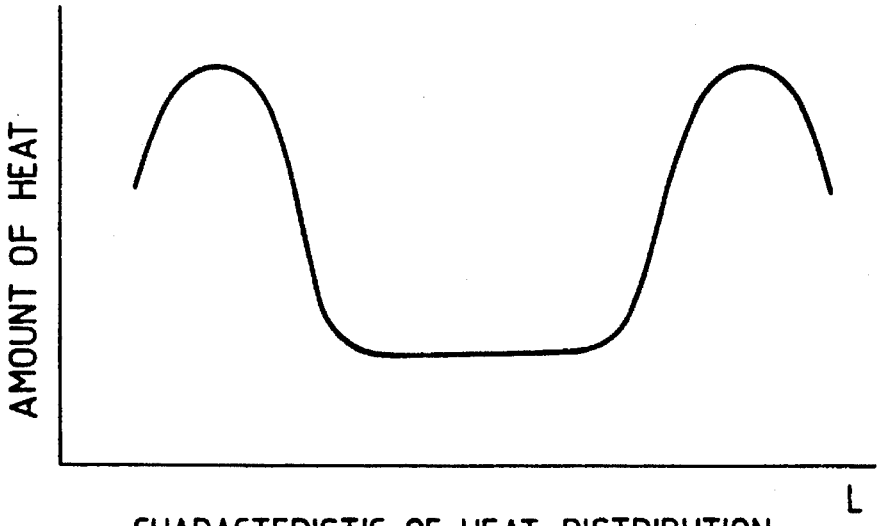
FIG. 8 is a chart showing the heat distribution characteristic of a sub heater shown in FIG. 6.

As shown in FIGS. 7 and 8, the heat amount distribution of the main heater 2 is higher at the central portion in the longitudinal direction (L) of the fixing roller, and lower at the end portions thereof, while that of the sub heater 3 is lower at the central portion and higher at the end portions, thereby complementing the heat distribution of the main heater 2. Therefore, the energization of the main heater 2 heats the central portion of the fixing roller 4 more than the end portions, while the energization of the sub heater 3 heats the end portions of the fixing roller 4 than in the central portion. Thus the use of two heaters of mutually complementing distributions realizes temperature control of the central and end portions of the fixing roller 4.

Figure 9:
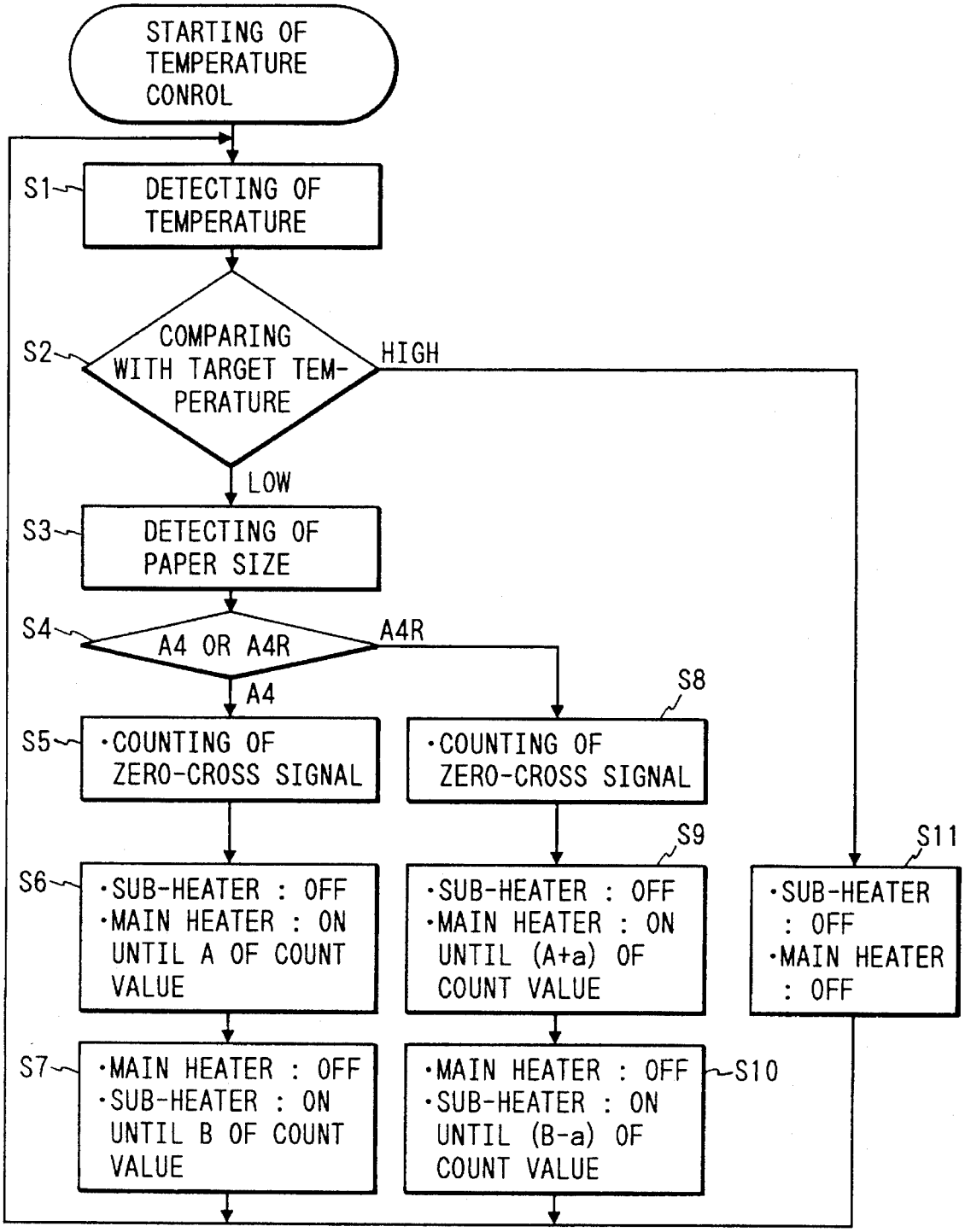
FIG. 9 is a flow chart of the temperature control sequence of the device shown in FIG. 6.
Figure 10:
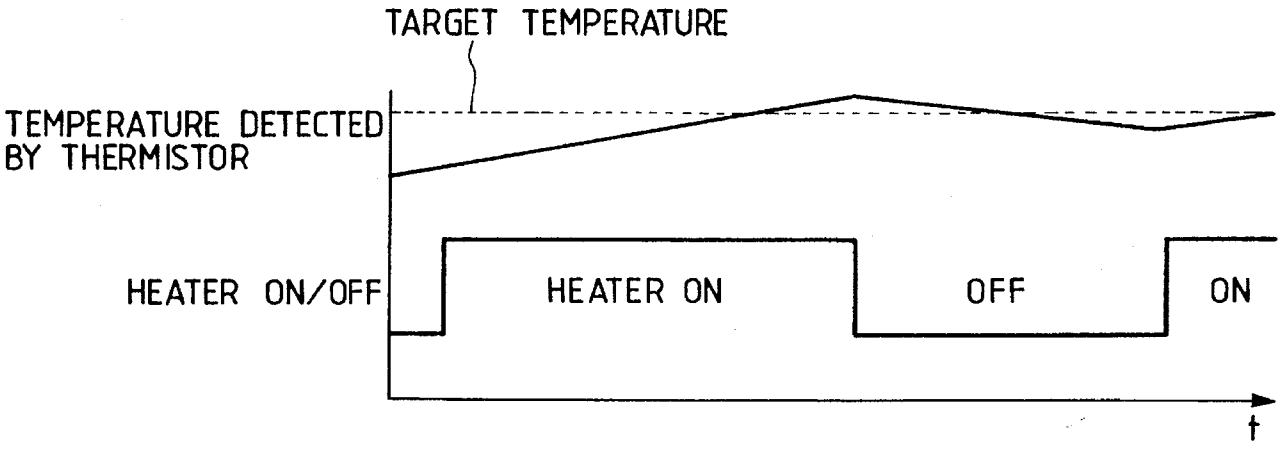
FIG. 10 is a chart showing the on/off timings of the heaters in the device shown in FIG. 6.
Figure 11:
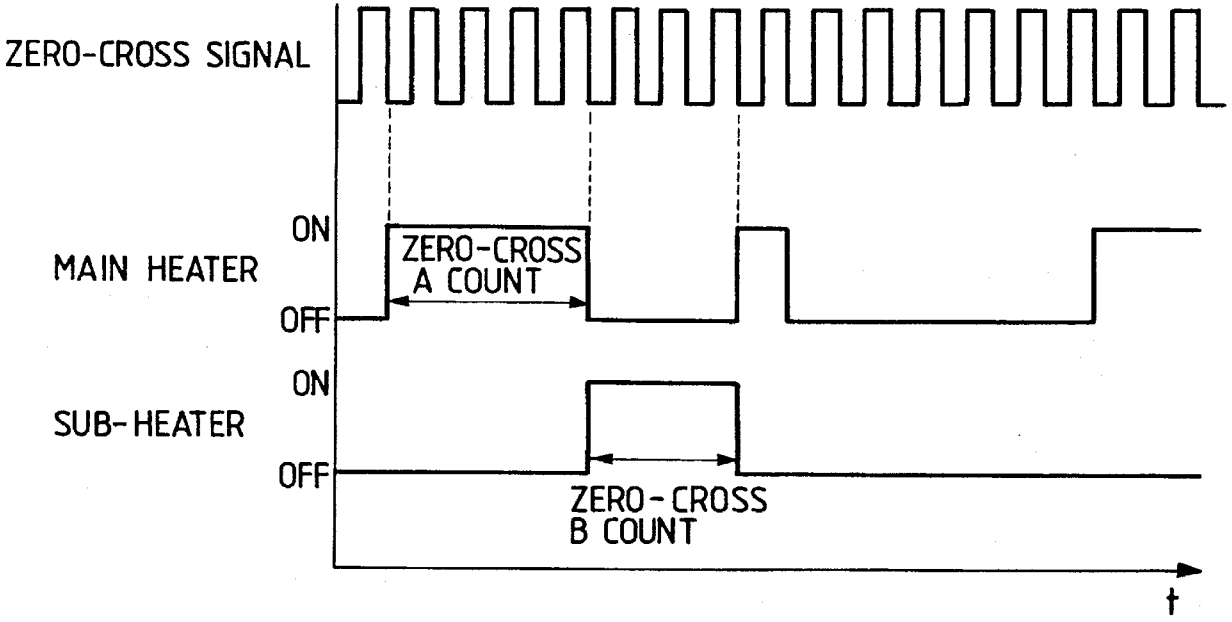
FIG. 11 is a chart showing the on/off timings of the main heater of the device shown in FIG. 6.
Figure 12:
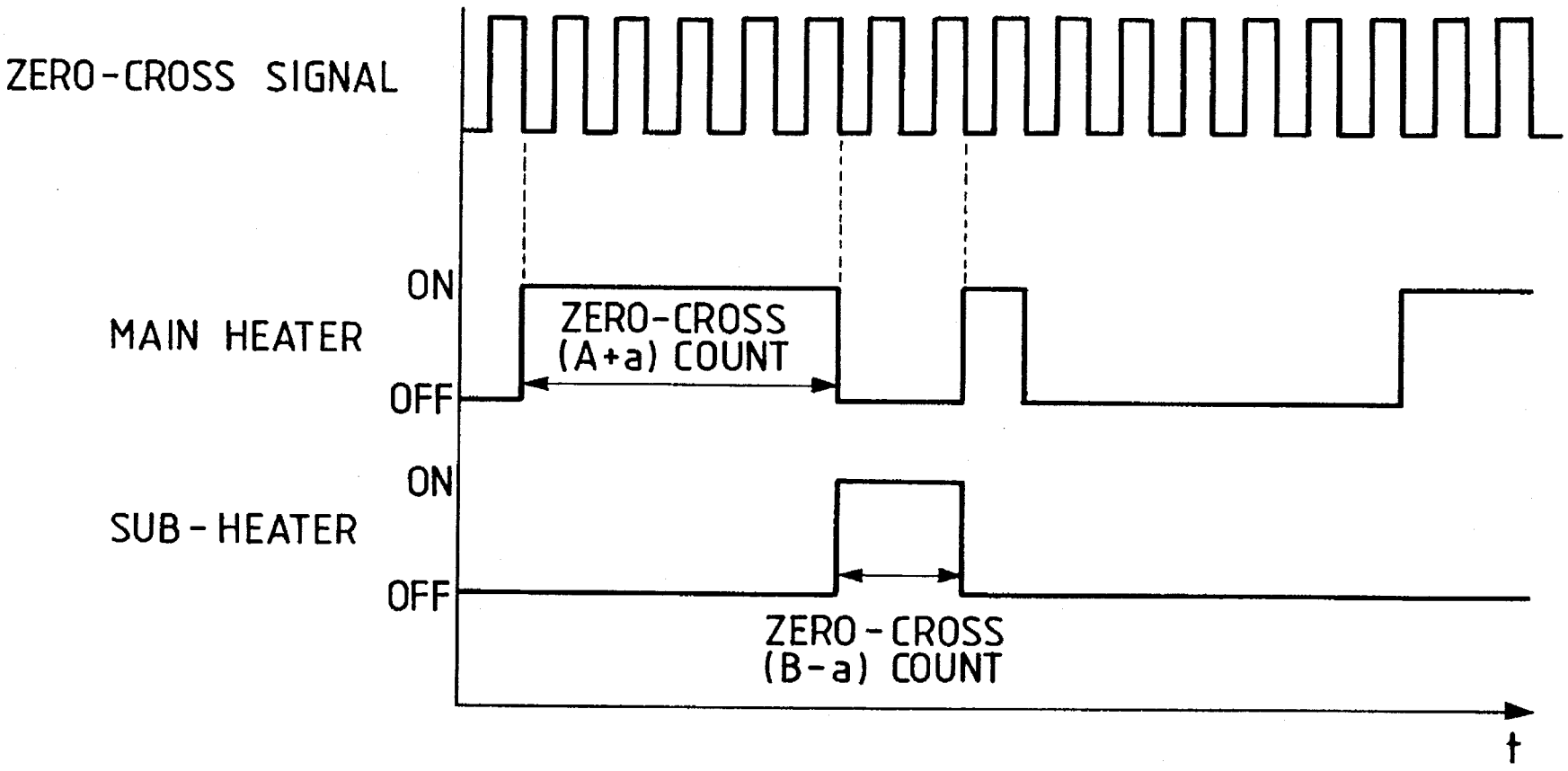
FIG. 12 is a chart showing the on/off timings of the sub heater of the device shown in FIG. 6.

In the following the functions of the present embodiment will be explained in detail, with reference to a flow chart in FIG. 9 showing the temperature control sequence of the CPU 1 and timing charts in FIGS. 10 to 12 showing the on/off timings of the fixing heaters.

At first the surface temperature of the fixing roller 4 is detected by the thermistor 5 (step S1 in FIG. 9) , and is compared with a target temperature (S2) . If the temperature is too high, a step S11 turns off the main heater 2 and the sub heater 3, and the sequence returns to the step S1 for temperature detection. If the temperature is low in the step S2, a step S3 causes the size detection means 11 to detect the size of the recording sheet, and a step S4 discriminates whether the sheet is A4 size or A4R size. If the recording sheet is for example A4 size, a step S5 starts the counting of zero-cross signals. Then a step S6 energizes the main heater 2 until said count reaches a predetermined value A, while maintaining the sub heater 3 deactivated during this period. Then a step S7 energizes the sub heater 3 until the count reaches a predetermined value B, while maintaining the main heater 2 deactivated during this period. On the other hand, if said step S4 identifies the sheet as of A4R size, a step S8 initiates the counting of the zero-cross signals, and a step S9 energizes the main heater 2 until the count reaches a value (A+a) which is corrected by a count a corresponding to the difference in width between the A4 size and the A4R size, while maintaining the sub heater 3 deactivated during this period. Then a step S10 energizes the sub heater 3 until said count reaches a value (B–a), while maintaining the main heater 2 deactivated during this period. Then the sequence returns to the step S1, and the temperature control of the fixing roller is executed by the repetition of the above-explained sequence.

FIGS. 10, 11 and 12 show the above-explained temperature control sequence as a function of time in the abscissa. As shown in FIG. 10, the temperature detected by the thermistor 5 varies as indicated by a solid line, gradually approaching a target temperature represented by a broken line. In this operation the heaters are turned on and off as illustrated. The details of the energization period of the heaters in FIG. 10 are shown in FIGS. 11 and 12, respectively for the A4 and A4R sheet sizes. In FIG. 11, the main heater 2 is turned on for a zero-cross signal count A, and the sub heater is thereafter turned on for a count B. In FIG. 12, the main heater is turned on for a count (A+a) and the sub heater is turned on for a count (B−a). Thus, when the width of the recording sheet is smaller than that of the roller (FIG. 12), the electrifying time of the sub heater 3, providing heat more in the end portions than in the central portion, is made shorter than in the case of FIG. 11 in which the width of the recording sheet is substantially same as that of the roller.

Figure 13:
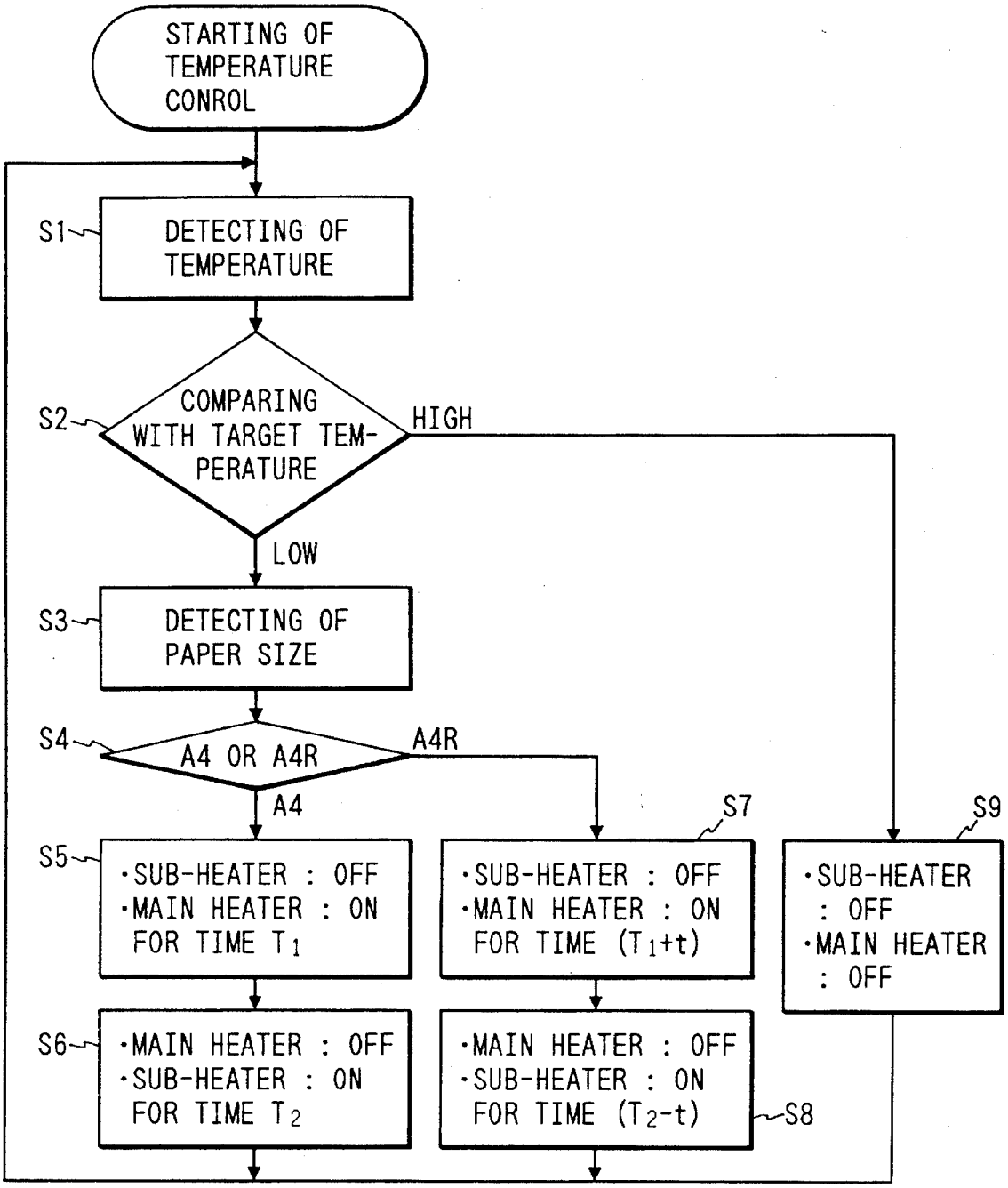
FIG. 13 is a flow chart of the temperature control sequence of another embodiment.

In the following there will be explained another embodiment of the present invention with reference to FIG. 13. The configuration of the present embodiment is same as shown in FIG. 6, and the distribution characteristics of the heaters are same as those shown in FIGS. 7 and 8, so that the on/off timings of the heaters alone will be explained with reference to FIG. 13. Also in FIG. 13, steps up to S4 for sheet size detection are the same as those of the foregoing embodiment shown in FIG. 9.

The step S4 discriminates whether the recording sheet is of A4 or A4R size, and, if the A4 size is identified, a step S5 energizes the main heater 2 for a period T1 while maintaining the sub heater 3 deactivated during this period. Then a step S6 energizes the sub heater 3 for a period T2 while maintaining the main heater 2 deactivated. On the other hand, if the step S4 identifies the sheet as A4R size, a step S7 energizes the main heater 2 for a period (T1+t) which is corrected by a period t corresponding to the difference in width of the A4 and A4R sizes, while maintaining the sub heater 4 deactivated during this period. Then a step S8 energizes the sub heater for a period (T2−t) while maintaining the main heater 2 deactivated. Then the sequence returns to the step S1, and the temperature control of the fixing roller is conducted by the repetition of the above-explained sequence.

Figure 14:
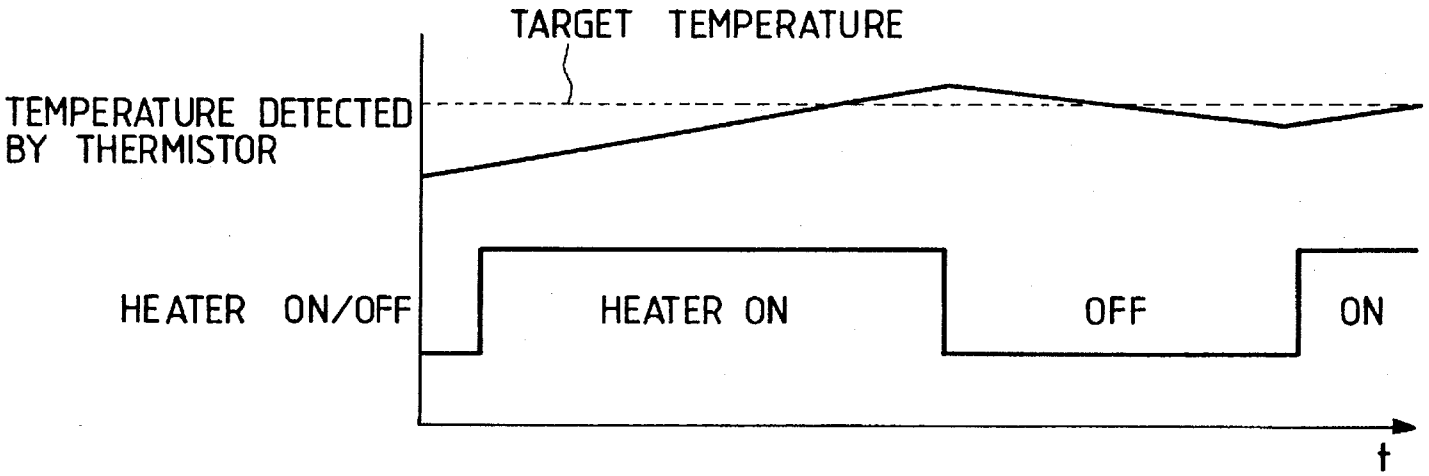
FIG. 14 is a chart showing the on/off timings of the heaters in the embodiment shown in FIG. 13.
Figure 15:
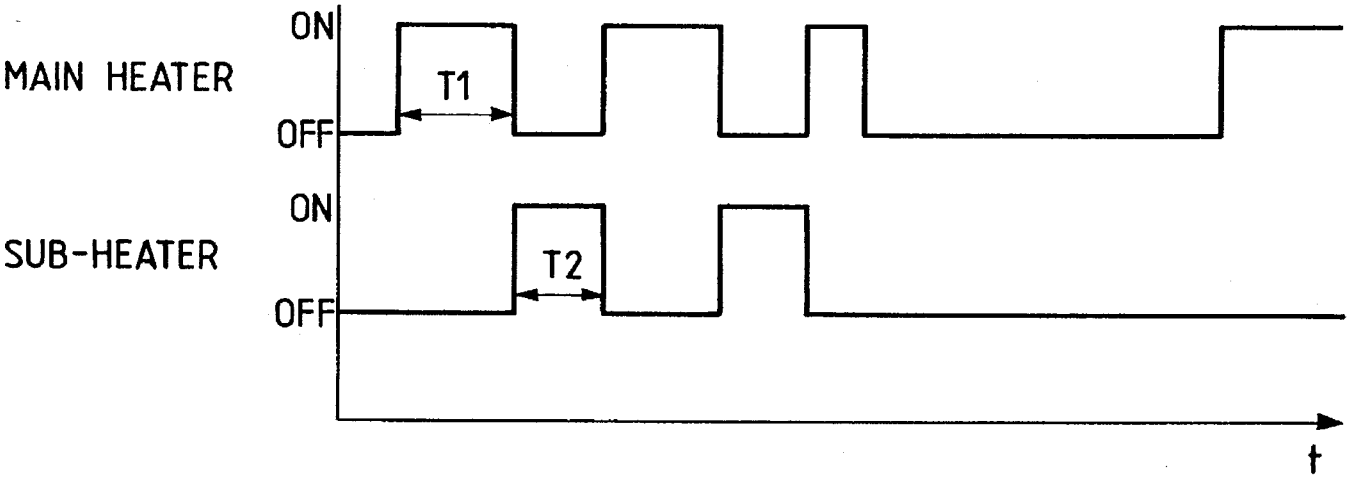
FIG. 15 is a chart showing the on/off timings of a main heater in the embodiment shown in FIG. 13.
Figure 16:
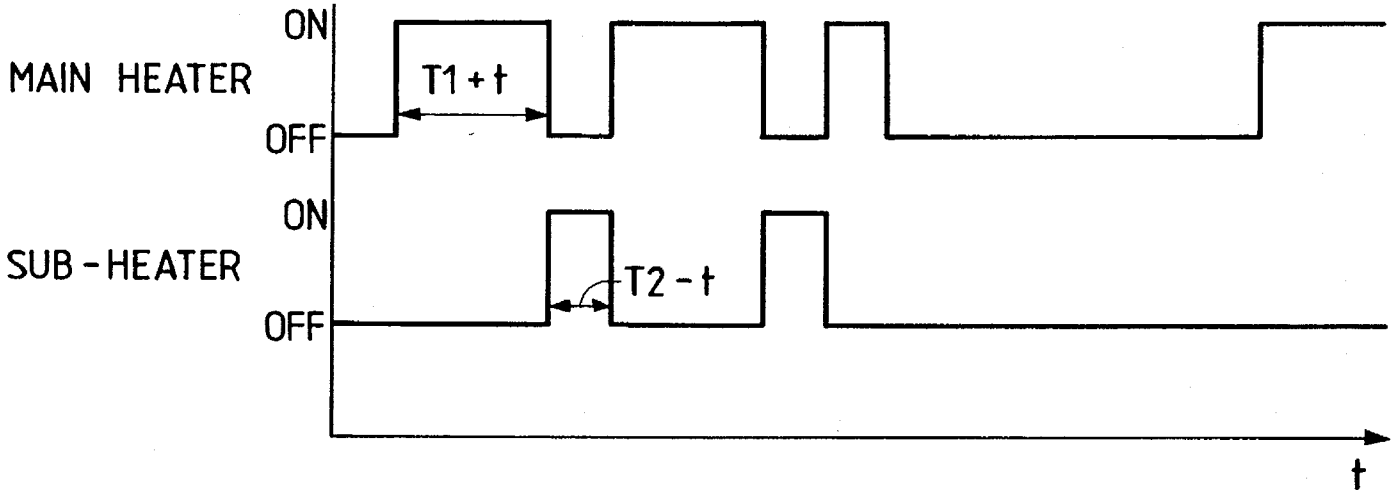
FIG. 16 is a chart showing the on/off timings of a sub heater in the embodiment shown in FIG. 13.

FIGS. 14, 15 and 16 show the above-explained temperature control sequence, as a function of time in the abscissa. As shown in FIG. 14, the temperature detected by the thermistor 5 varies as indicated by a solid line, gradually approaching a target temperature represented by a broken line. In this operation the heaters are turned on and off as illustrated. The details of the energization period of the heaters in FIG. 14 are shown in FIGS. 15 and 16, respectively for the A4 and A4R sheet sizes. In FIG. 15, the main heater is turned on for a period T1, and the sub heater 3 is thereafter turned on for a period T2. In FIG. 16, the main heater 2 is turned on for a period (T1+t) and the sub heater 3 is thereafter turned on for a period (T2−t). Thus, when the width of the recording sheet is smaller than that of the roller (FIG. 16), the electrifying time of the sub heater 3, providing heat more in the end portions than in the central portion, is made shorter than in the case of FIG. 15 in which the width of the recording sheet is substantially same as that of the roller.

In the following there will be explained still another embodiment. In the foregoing embodiment, the on/off signals for the main and sub heaters are varied by an internal time of the CPU in order to vary the on/off timings of the heaters. In this embodiment, the on/off timings are varied by an on/off signal for the main heater and a control signal representing the turn-on period of the heaters, for example by means of a circuit shown in FIG. 17.

Figure 17:
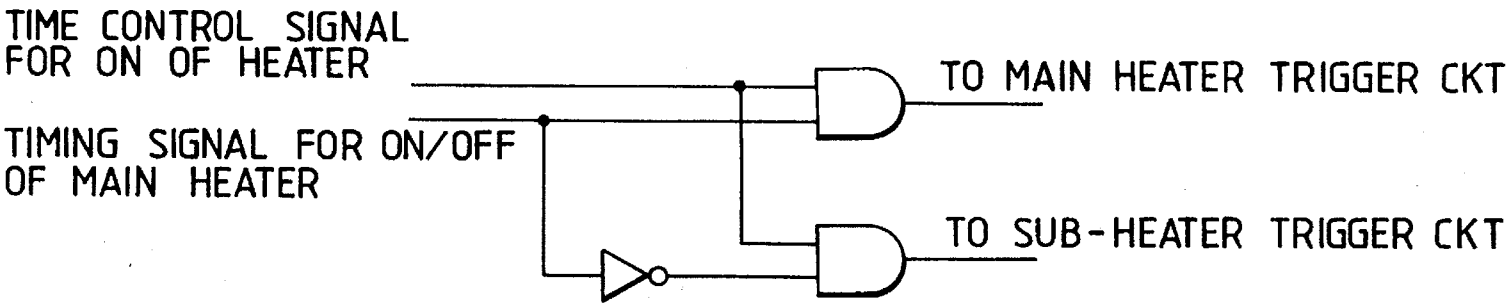
FIG. 17 is a circuit diagram showing another embodiment.

Referring to FIG. 17, a signal to be supplied to the trigger circuit of the main heater is generated in an AND gate from an on/off signal for the main heater and a control signal representing the on-period of the heaters, while a signal to be supplied to the trigger circuit of the sub heater is generated in an AND gate from an inverted signal of said on/off signal and the control signal representing the on-period of the heaters. It is thus possible, by means of the above-explained circuit, to generate the trigger signals for the heaters, thereby realizing the on/off timings for the heaters shown in FIGS. 10 and 11. Also, since the trigger signal for the sub heater is generated from the inverted signal of the on/off signal for the main heater, the main and sub heaters are not energized simultaneously, and this configuration is therefore effective in case that the power supply has insufficient margin in the power or in the current.

Figure 18:
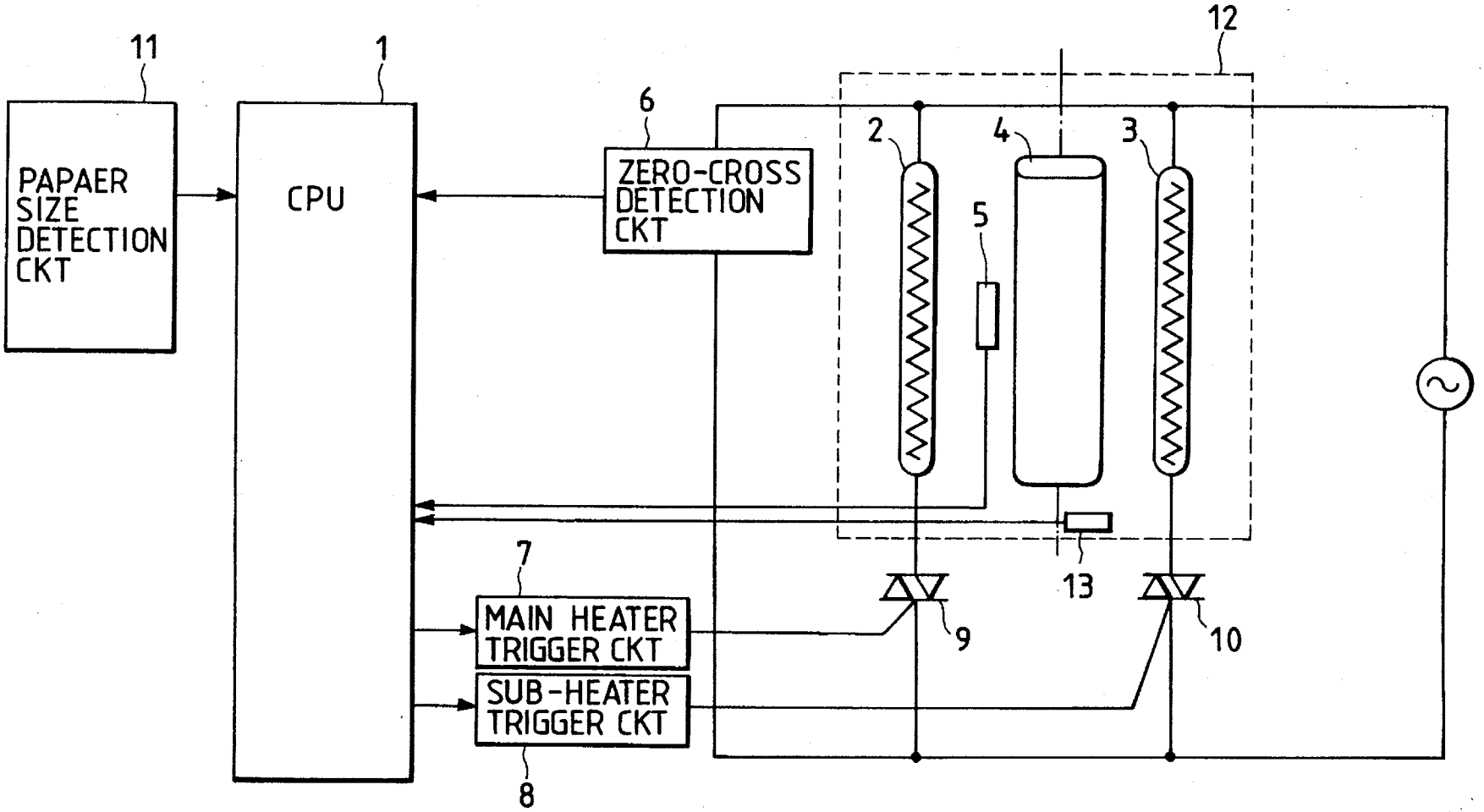
FIG. 18 is a block diagram of another embodiment of the device of the present invention.

In the following there will be explained still another embodiment, of which block diagram is shown in FIG. 18 and of which heaters are of the distribution characteristics shown in FIGS. 7 and 8. The present embodiment is additionally equipped with a sheet sensor 13.

Figure 19:
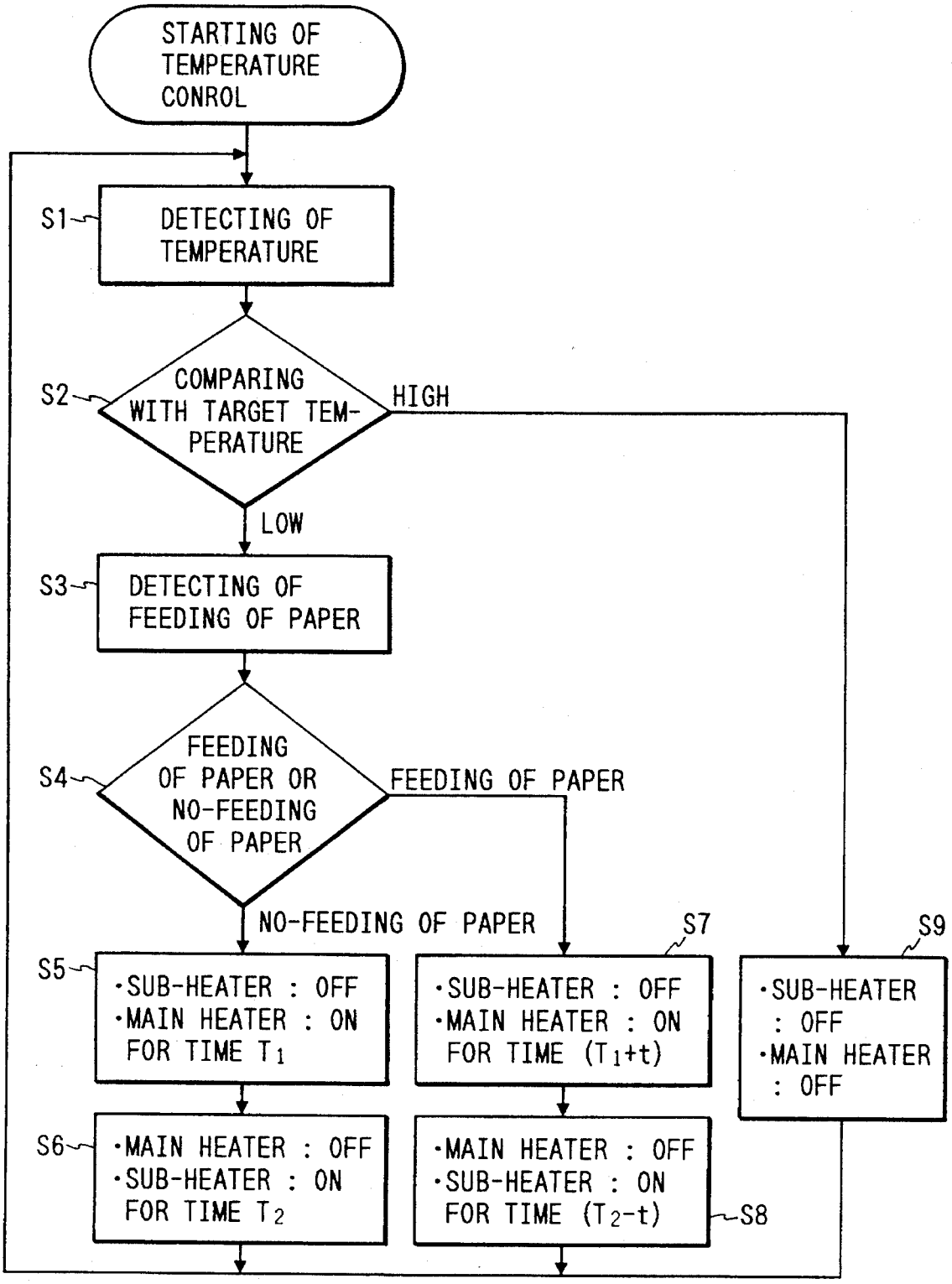
FIG. 19 is a flow chart of the temperature control sequence of the device shown in FIG. 18.
Figure 20:
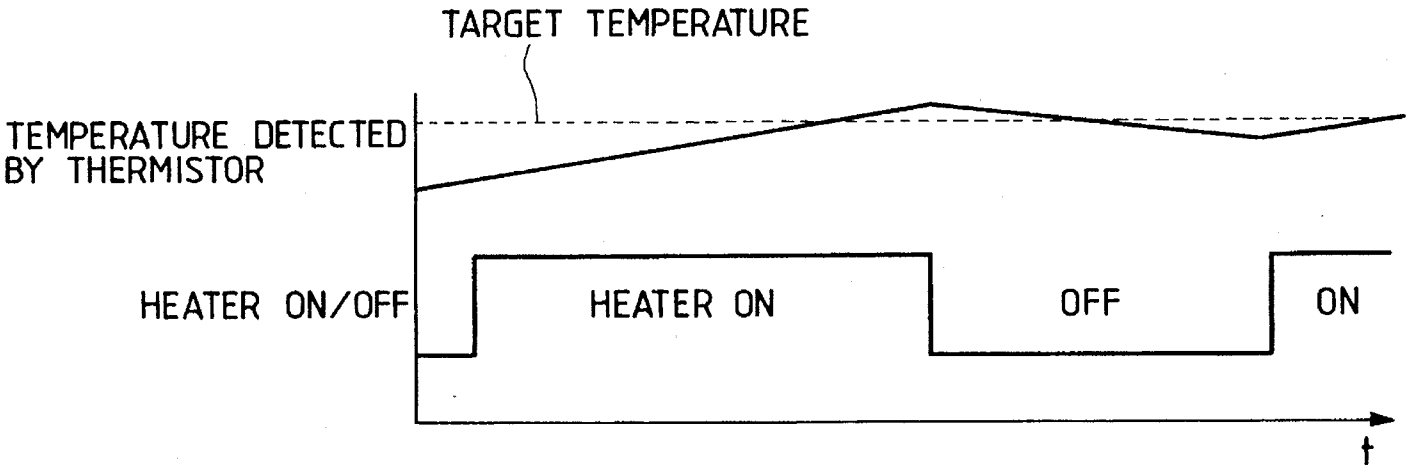
FIG. 20 is a chart showing the on/off timings of the heaters in the device shown in FIG. 18.
Figure 21:
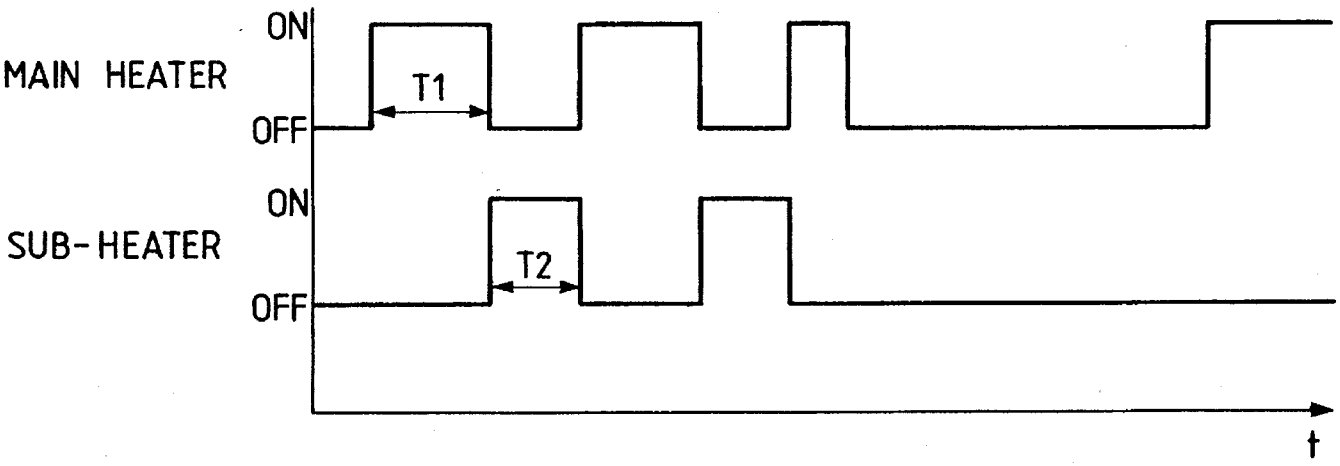
FIG. 21 is a chart showing the on/off timings of a main heater in the device shown in FIG. 18.
Figure 22:
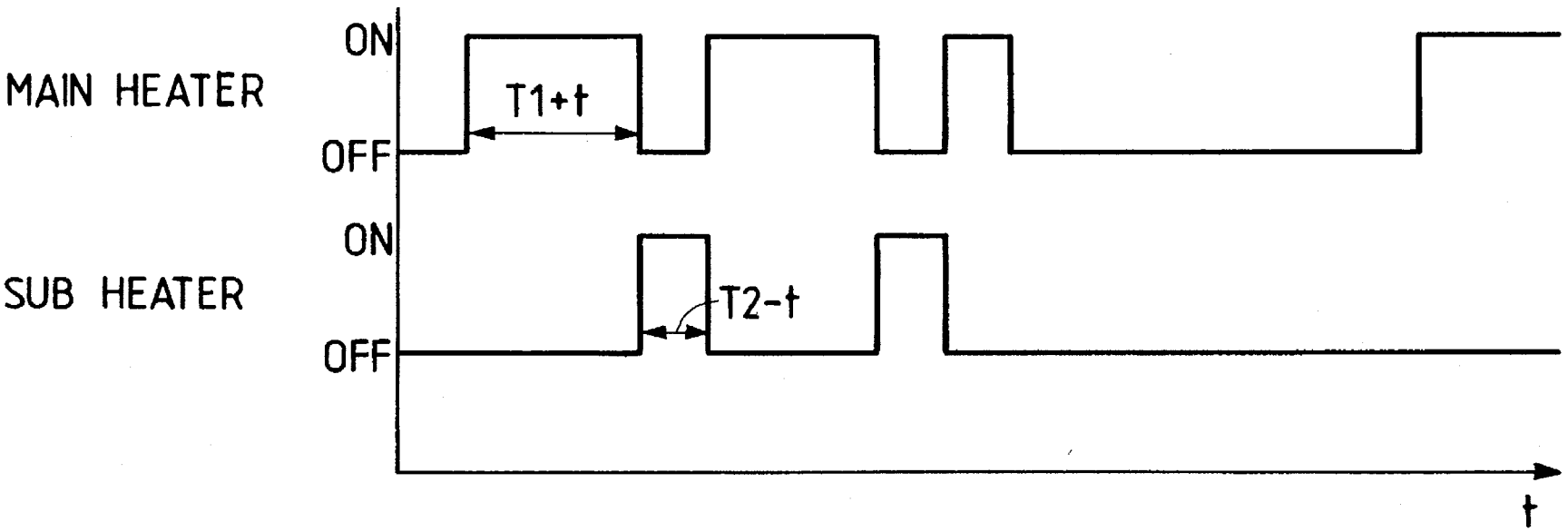
FIG. 22 is a chart showing the on/off timings of a sub heater in the device shown in FIG. 18.

The detailed functions of the present embodiment will be explained with reference to a flow chart in FIG. 19 showing the temperature control sequence of the CPU 1 and timing charts in FIGS. 20 to 22 showing the on/off timings of the fixing heaters.

At first the surface temperature of the fixing roller 4 is detected by the thermistor 5 (step S1), and is compared with a target temperature (S2). If the temperature is too high, a step S9 turns off the main heater 2 and the sub heater 3, and the sequence returns to the step S1 for temperature detection. If the temperature in the step S2 is low, a step S3 causes the sheet detection means 14 to detect the passing of the recording sheet, and a step S4 discriminates whether a recording sheet is currently passing the fixing roller. If not, a step S5 turns on the main heater 2 for a period T1 and turns off the sub heater 3 for the period. Then a step S6 turns on the sub heater for a period T3, and turns off the main heater 2 for the period. On the other hand, if the step S4 identifies that a recording sheet is currently passing the fixing roller, a step S7 turns on the main heater 2 for a period (T1+t), and turns off the sub heater 3 for the period. Then a step S8 turns on the sub heater for a period (T2−t), and turns off the main heater 2 for the period. Subsequently, the sequence returns to the step S1, and the temperature control for the fixing roller is executed by the repetition of the above-explained sequence.

FIGS. 20, 21 and 22 show the above-explained temperature control sequence, as a function of time in the abscissa. As shown in FIG. 20, the temperature detected by the thermistor 5 varies an indicated by a solid line, gradually approaching a target temperature represented by a broken line. In this operation the heaters are turned on and off as illustrated. The details of the energization period of the heaters in FIG. 20 are shown in FIGS. 21 and 22, respectively when a recording sheet passes or does not pass the fixing roller. In FIG. 21 the main heater 2 is turned on for a period T1, and the sub heater 3 is thereafter turned on for a period T2. On the other hand, in FIG. 22, the main heater 2 is turned on for a period (T1+t) and the sub heater 3 is thereafter turned on for a period (T2–t). In case that the recording sheet passes the fixing roller (FIG. 22), the heat of the fixing roller is taken away by the recording sheet, more in the central portion than in the end portions. Thus, the on/off timings of the heaters are so modified that the electrifying time of the main heater 2, providing the heat more in the central portion than in the end portions, is prolonged in comparison with the case in which the recording sheet does not pass the fixing roller (the case of FIG. 21), and the electrifying time of the sub heater, providing the heat more in the end portions than in the central portion, is shortened.

Figure 23:
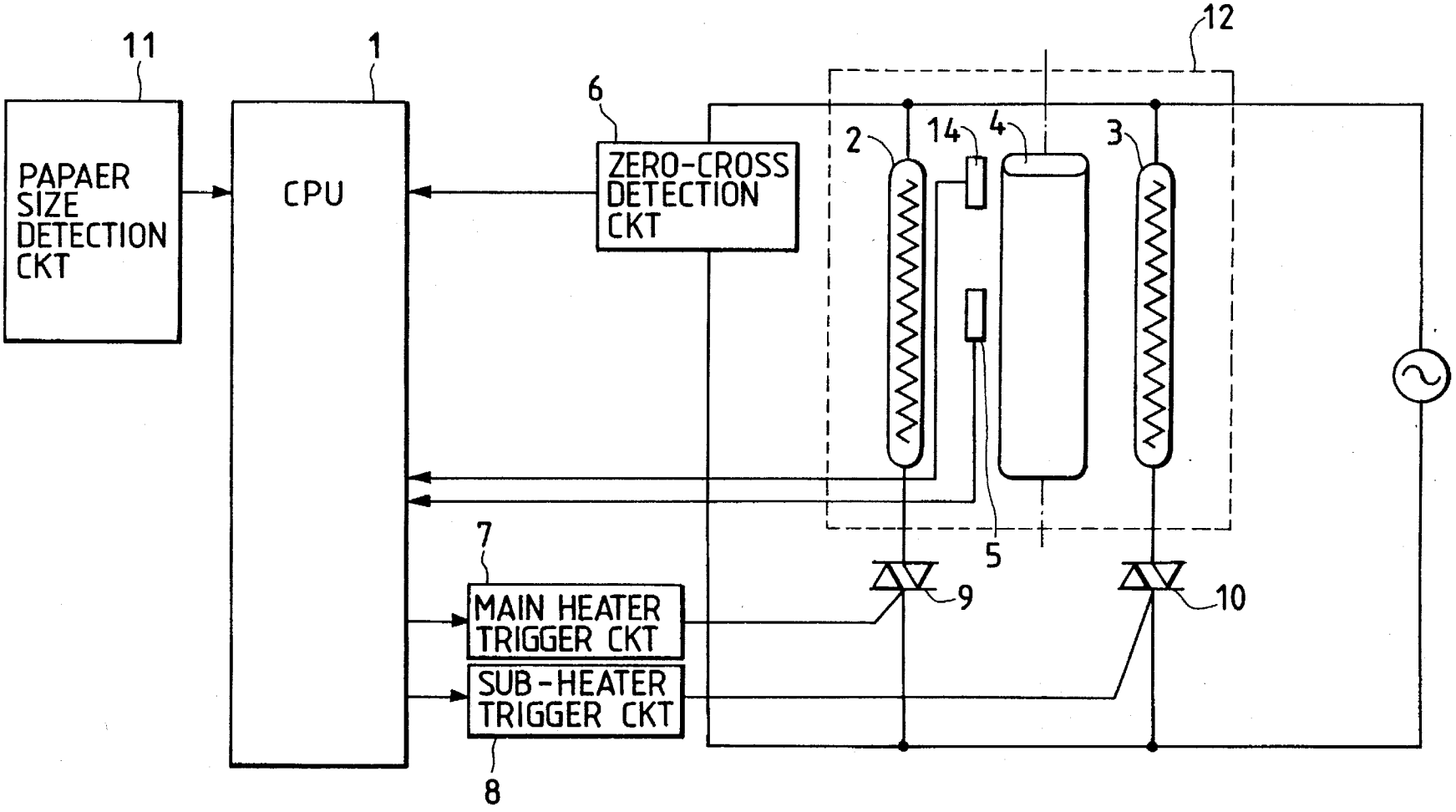
FIG. 23 is a block diagram of another embodiment.

FIG. 23 is a block diagram of still another embodiment of the present invention, which is different from the device shown in FIG. 18 in the absence of the sheet sensor 13 and the presence of a thermistor 14 for detecting the temperature of an end of the roller. Otherwise the device shown in FIG. 23 is same as that in FIG. 18, so that the same components as those in FIG. 18 are represented by same numbers and will not be explained further. The distribution characteristics of the heaters are same as those in FIGS. 7 and 8.

Figure 24:
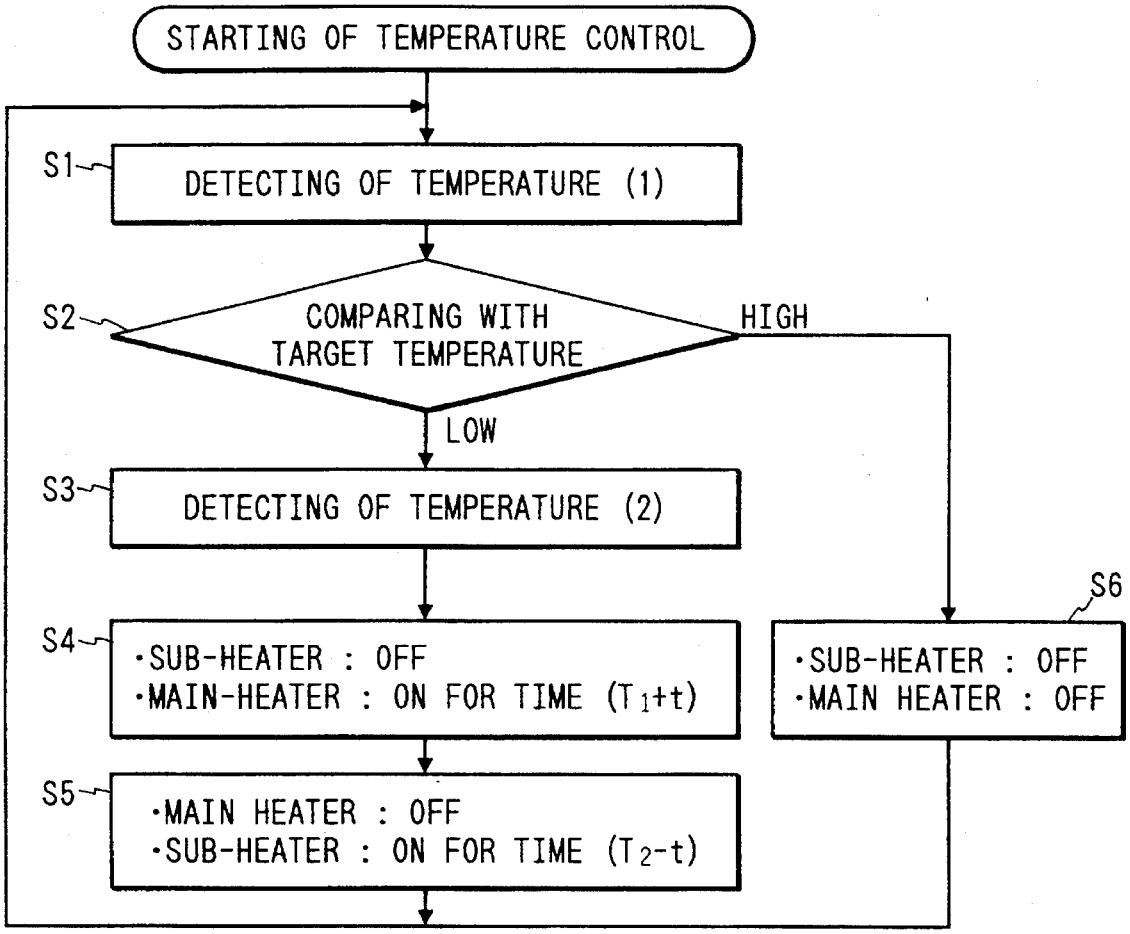
FIG. 24 is a flow chart of the temperature control sequence of the embodiment shown in FIG. 23.

The on/off timings of the heaters will be explained with reference to FIG. 24. At first the surface temperature in the central portion of the fixing roller 4 is detected by the thermistor 5 (S1) and is compared with a target temperature (S2). If the temperature is too high, a step S6 turns off the main heater 2 and the sub heater 3 and the sequence returns to the step S1 for temperature detection. If the step S2 identifies that the temperature is low, a step S3 causes the thermistor 14 to detect the surface temperature at an end portion of the fixing roller 4. Then a step S4 turns on the main heater 2 for a period (T1+t) and turns off the sub heater 3 during the period. Then a step S5 turns on the sub heater 3 for a period (T2–t) and turns off the main heater 2 for the period. The value t is varied according to the roller end temperature detected in the step S3, for example, being increased or decreased if the temperature is high or low. Then the sequence returns to the step S1 and the temperature control of the fixing roller is executed by repetition of the above-explained sequence.

Figure 25:
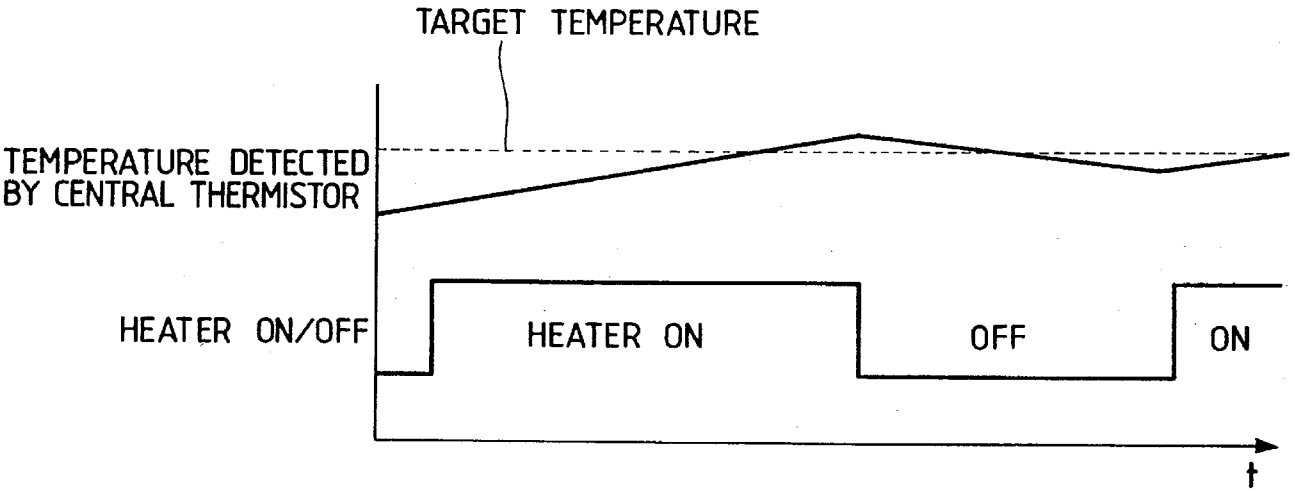
FIG. 25 is a chart showing the on/off timings of heaters in the embodiment shown in FIG. 24.
Figure 26:
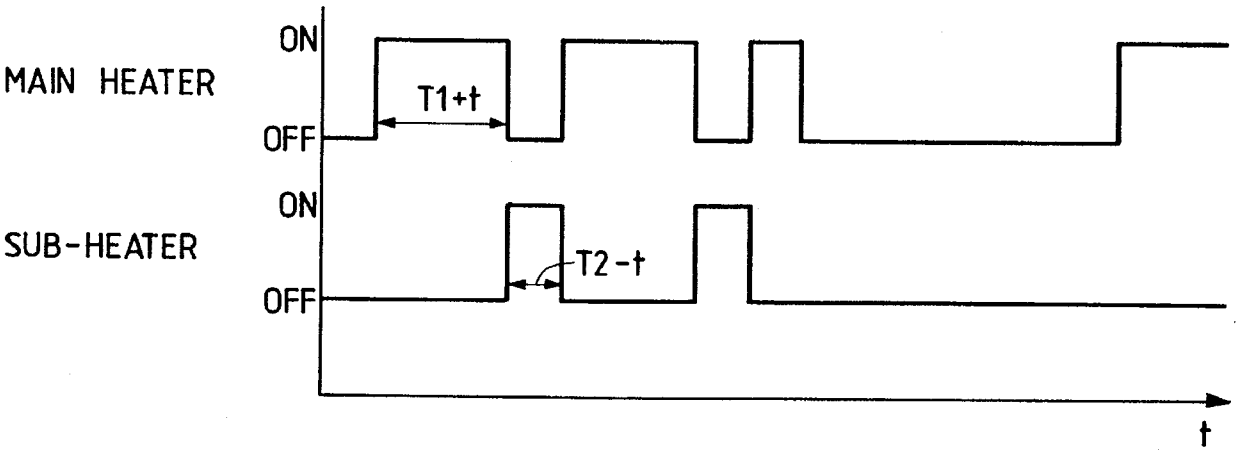
FIG. 26 is a chart showing the on/off timings of main and sub heaters in the embodiment shown in FIG. 24.

FIGS. 25 and 26 show the above-explained temperature control sequence, as a function of time in the abscissa. As shown in FIG. 25, the temperature detected by the thermistor 14 varies as indicated by a solid line, gradually approaching a target temperature represented by a broken line. In this operation the heaters are turned on and off as illustrated. The details of the energization period of the heaters in FIG. 25 are shown in FIG. 26, in which the main heater 2 is turned on for a period (T1+t) and the sub heater 3 is thereafter turned on for a period (T2–t). As explained above, the value t is increased or decreased respectively if the detected temperature at the end portion of the fixing roller is high or low. Thus, when the temperature at the end portion of the roller becomes higher, the on/off timings of the heaters are so varied that the electrifying time of the sub heater, giving the heat more in the end portions than in the central portion, is shortened in comparison with the case in which the end portion temperature is not high.

In the following there will be explained still another embodiment of the present invention.

Figure 27:
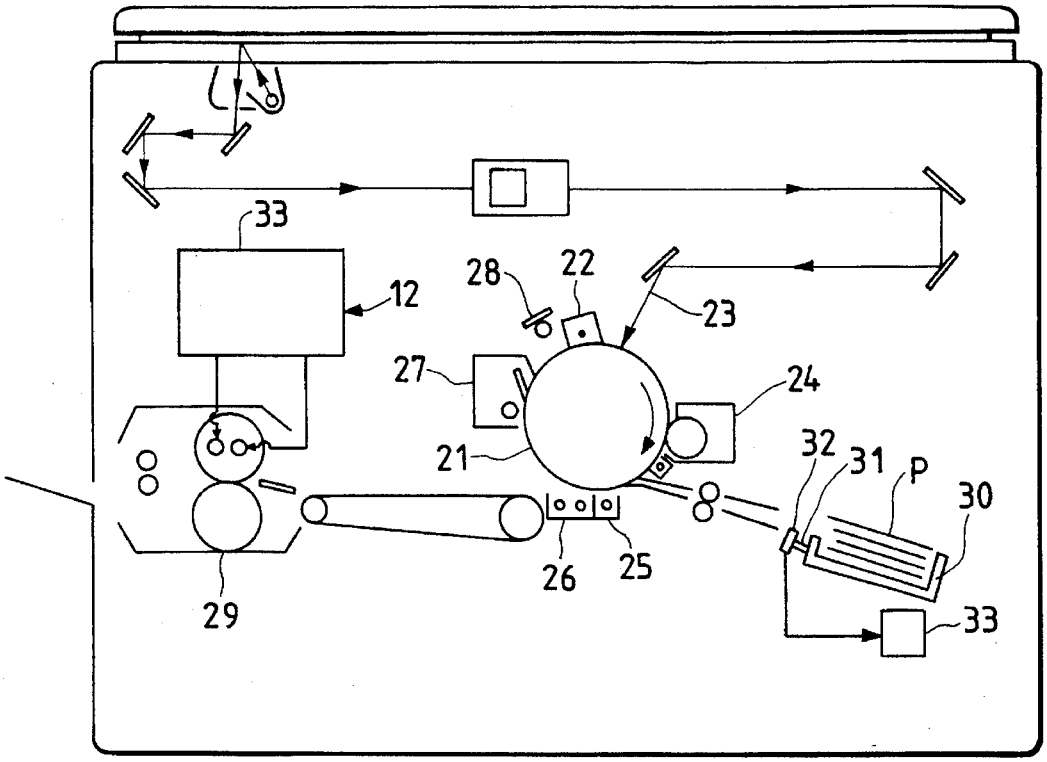
FIG. 27 is a cross-sectional view of an image forming apparatus, employing the fixing device embodying the present invention.

FIG. 27 is a cross-sectional view of an image forming apparatus employing the image heating device of the present embodiment as a fixing device.

As already well known, a configuration for forming a toner image is composed of a photosensitive member 21, around which is provided a charger 22, an image exposure unit 23, a developing unit 24, transfer-separating chargers 25, 26, a cleaning unit 27 and a pre-exposure unit 28. A toner image is electrophotographically formed on the photosensitive member 21.

The toner image is transferred as an unfixed toner image onto a recording sheet (paper) P supplied from a container 30. The sheet is subsequently transferred to a fixing device 29 in which the toner image is fixed as a permanent image.

The container 30, detachable from the main body of the apparatus, is provided with a sheet size identifying button 31, which is read by a sheet size sensor 32 provided in the main body of the apparatus, and a sheet size signal is sent from the sensor 32 to a control circuit 33, which also counts the number of consecutive image forming operations.

Figure 28:
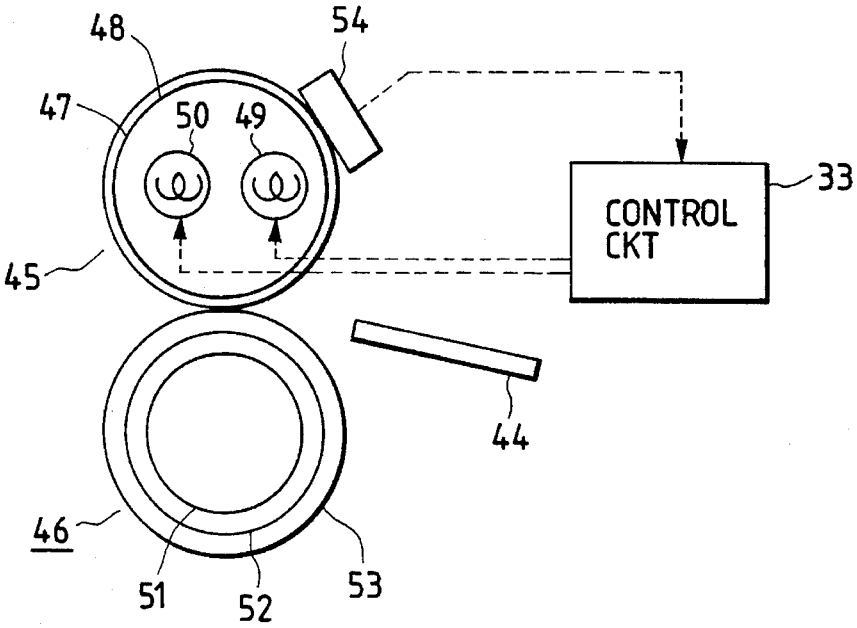
FIG. 28 is a magnified cross-sectional view of the fixing device employed in the embodiment shown in FIG. 27.

FIG. 28 is a magnified cross-sectional view of a fixing device 29.

A recording sheet bearing an unfixed toner image is guided by a guide 44 to the nip between a fixing roller 45 and a pressure roller 46, and the toner image. is fixed to the recording sheet by heat and pressure while it passes the nip.

The fixing roller 45 is composed of a hollow steel cylinder 47 of a thickness of 0.7 mm and a releasing layer 48 of fluorinated resin, provided on the cylinder.

Inside the cylinder 47 there are provided two heaters 49, 50 of different heat distributions. The pressure roller 46 is composed of a hollow metal cylinder 51, an elastic silicone rubber layer 52 provided on the external periphery thereof, and a fluorinated resin layer 53 coated thereon for further improving releasing character.

The surface temperature of the fixing roller is detected by a temperature sensor 54, of which output signals is supplied to the control circuit 33 for controlling the on/off timings of two heaters of mutually different heat distribution characteristics.

In the following there will be explained the heat distribution of the heaters 49, 50.

In the image forming apparatus of the present embodiment, the recording sheet is transported always at the center as the basis of reference, regardless of the size thereof.

Figure 29:
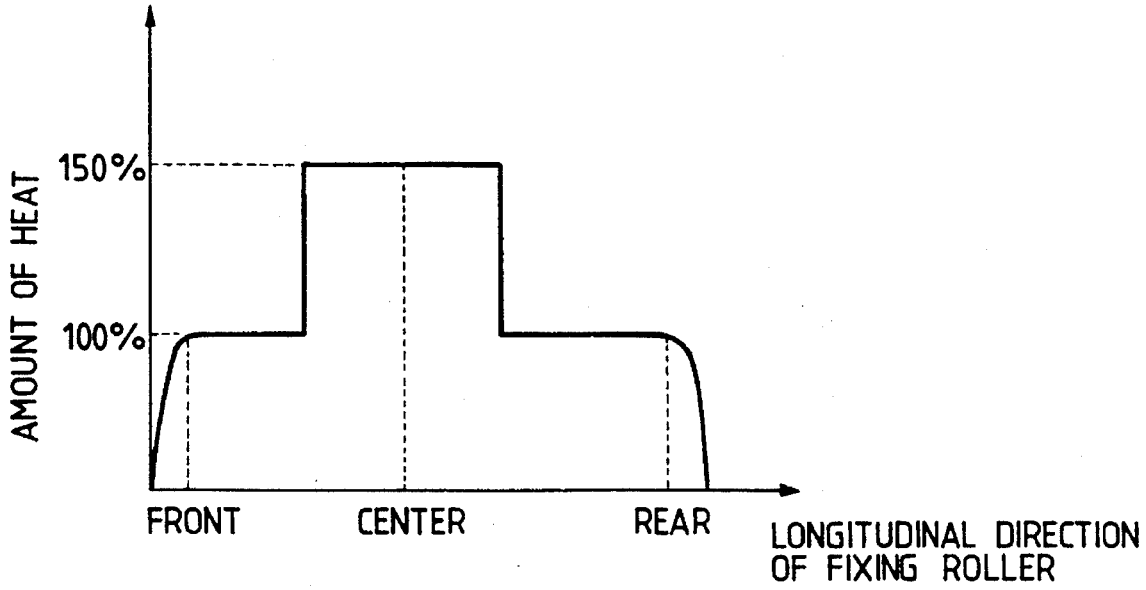
FIG. 29 is a chart showing the heat amount distribution of a main heater.
Figure 30:
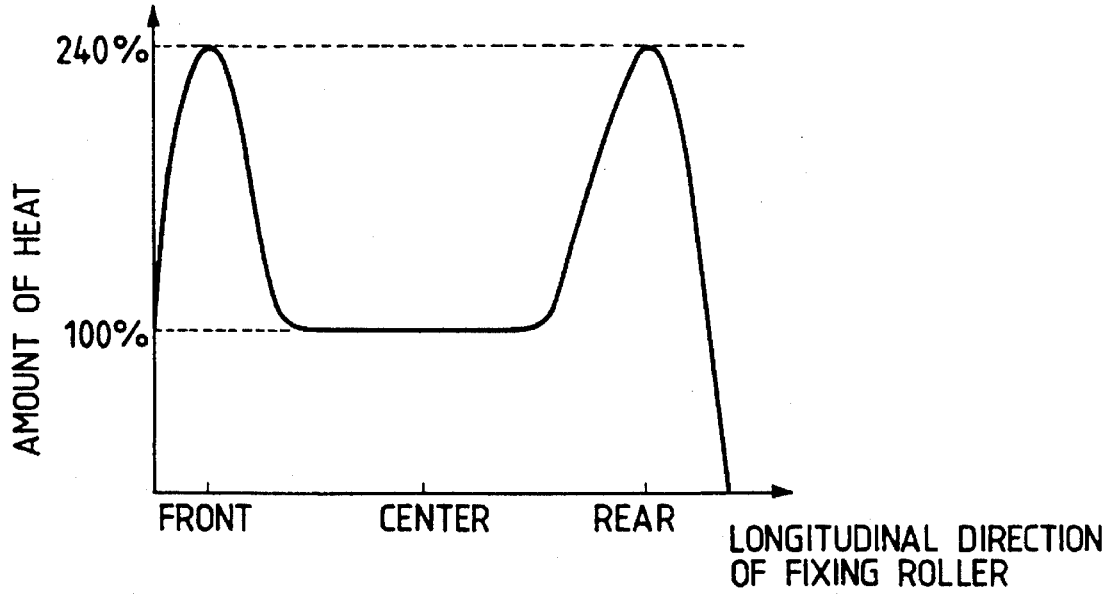
FIG. 30 is a chart showing the heat amount distribution of a sub heater.

FIG. 29 shows the heat distribution pattern of a main heater 49, of which heat amount is concentrated in a central portion in the longitudinal direction of the fixing roller, wherein the width of the central portion matches the width of a smaller-sized sheet. FIG. 30 shows the heat distribution pattern of a sub heater 50, of which heat amount is concentrated in end portions in the longitudinal direction. The electric powers employed in this embodiment are 700 W and 600 W respectively for the main heater and the sub heater.

In the following explained are the on/off timings of the heaters 49, 50.

The small-sized sheet means the legal size or smaller, and the large-sized sheet means the ledger size or larger.

In case of image formation on a small-sized sheet, since the heat of the fixing roller is taken away mainly in the central portion, the main heater 49 alone is energized while the sub heater 50 is turned off.

In case of image formation on a large-sized sheet, since the heat is taken away also from the end portions in the logitudinal direction of the fixing roller, the end portions become lower in temperature, thus leading to defective fixing if the main heater alone is used. Consequently the temperature distribution in the longitudinal direction of the fixing roller is made uniform by alternately turning on and off the main heater and the sub heater. In the present embodiment, satisfactory temperature distribution could be obtained with a ratio of 4:1 in the electrifying time of the main heater and the sub heater. More specifically, while the signal to energize the heaters is emitted from the control circuit 13, the main heater was energized for 0.4 seconds and the sub heater was energized then for 0.1 seconds within a cycle time of 0.5 seconds.

In the following there will be explained the control of the on/off timings of the heaters, in relation to the sheet size and the number of continuous image formations.

In case of image formation on a sheet of maximum or minimum size, there will not result the high temperature offsetting or the defective fixation even in continuous image formations with a fixed on/off timing of the heaters, because the heat distributions of the heaters 49, 50 approximately coincide with the sheet size.

However, in case of image formation on a sheet of intermediate size, for example the sheet of A4 size transported longitudinally, the temperature distribution of the fixing roller varies significantly as the image forming operations are repeated continuously.

In the following there will be explained phenomena in case of continuous image formations with the A4-sized sheets transported longitudinally.

Figure 31:
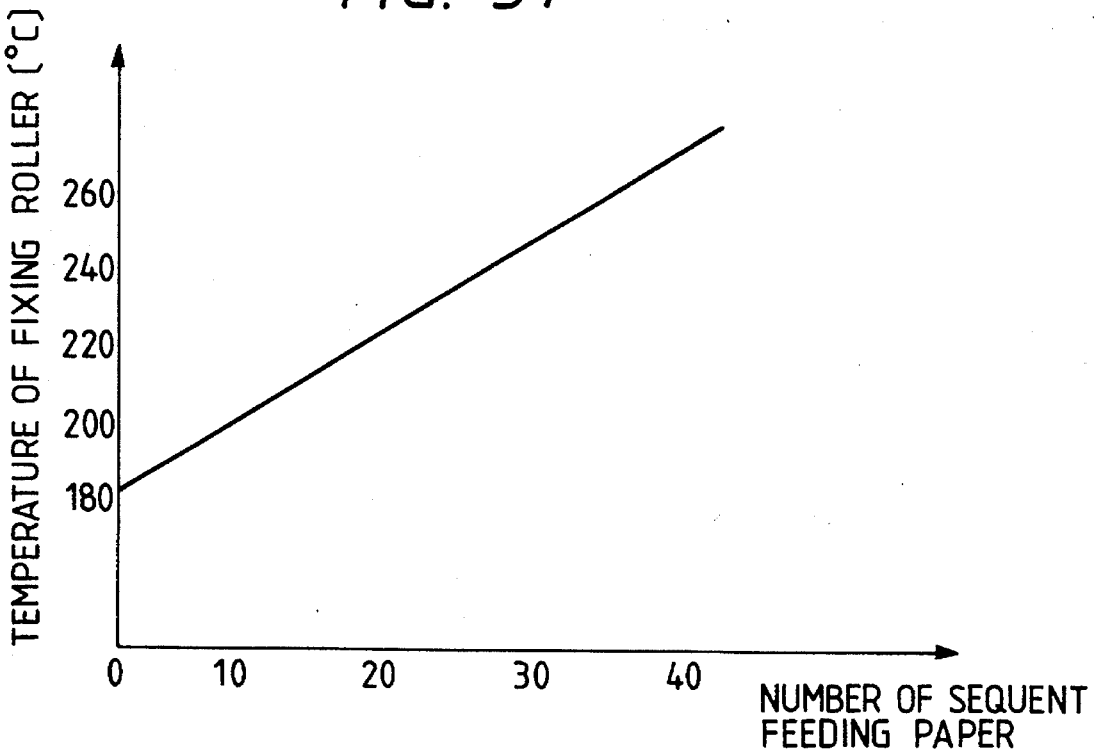
FIG. 31 is a chart showing temperature change of a fixing roller in a part where the paper does not pass.

In case the number of transported sheets is five or less, the A4-sized sheets transported longitudinally will show deficient fixation at both ends if the fixation is conducted with the main heater only. Consequently the sub heater has to be energized with a ratio of 1:4 or larger in energization time to the main heater. FIG. 31 shows the temperature of a portion, where the recording sheets do not pass, of the fixing roller as a function of the number of continuously transported sheets, in case the main heater and the sub heater are energized with a ratio of 1:4 in energization times.

FIG. 31 indicates that said portion, where the recording sheets do not pass, reaches 230° C.

In the device of the present embodiment, the fixing roller can withstand a high temperature up to 230° C.

In the present embodiment, therefore, the ratio of energization times of the main heater and the sub heater is varied at the 21st sheet and thereafter to turn on the main heater only, thereby suppressing the temperature rise in the portion where the recording sheets do not pass.

That is, when the number of continuous image formations reaches 21 or larger, the main heater 19 alone is energized while the sub heater 20 is deactivated.

When the main heater 19 alone is energized after the 21st sheet, the temperature at both end portions of the fixing roller is gradually lowered to such a level that the number of transported sheets is five or less, but there can be assured satisfactory image fixation at the end portions of the A4-sized sheets transported longitudinally, because the pressure roller 46 is sufficiently warm.

As explained in the foregoing, it is possible to prevent the defective fixation or the high temperature offsetting, by suitably varying the ratio in energization times of the main heater and the sub heater according to the sheet size and the number of continuously transported sheets.

In the following explained is still another embodiment of the present invention.

In case of fixing thicker recording sheets, a larger amount of heat is supplied to the fixing roller as a larger amount of heat is taken away by such thicker sheets, so that the portion where the recording sheets do not pass shows a larger temperature rise.

On the other hand, at a same fixing temperature, the image fixation is more difficult on such thicker sheets than on the ordinary paper. Consequently, even if the main heater alone is energized at the 21st and subsequent sheets as in the foregoing embodiment, there will result the high temperature offsetting because the portion where the recording sheets do not pass shows a larger temperature rise and exceeds 230° C. already at the 20th or earlier sheet. Also if the main heater alone is energized at the 20th or earlier sheet where the temperature of the portion does not reach 230° C., there will result defective image fixation because the temperature of the fixing roller in the portions corresponding to the end portions of the longitudinally transported A4-sized sheet and also because such thicker sheet has inferior image fixing ability.

For these reasons, in the present embodiment, upon detection of thicker sheets, the ratio of energization times of the main heater to the sub heater is increased for every five continuous image formations.

Figure 32:
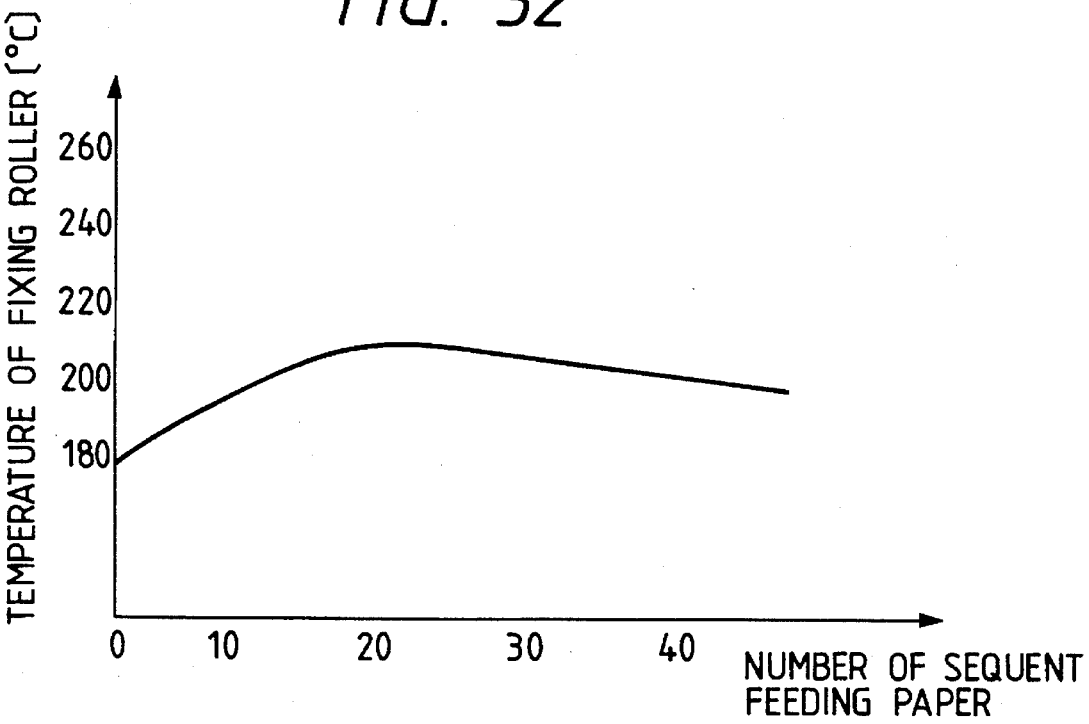
FIG. 32 is a chart showing temperature change of a fixing roller in a part where the paper does not pass.

FIG. 32 shows the temperature change in the portion, where the recording sheets do not pass, of the fixing roller. As will be understood from FIG. 32, the fixing roller always shows satisfactory temperature distribution. Specific ratios of energization times are shown in the following table 1:

TABLE 1

| Heater | Ratio of energization times | |
|---|---|---|
| Sheet number | Main heater | Sub heater |
| 1–5 | 4 | 1 |
| 6–10 | 6 | 1 |
| 11–15 | 8 | 1 |
| 16–20 | 10 | 1 |
| 21– | ∞ | 0 |

It is possible, in this manner, to prevent the high temperature offsetting and the defective image fixation even on thicker recording sheets, by increasing the ratio of energization time of the main heater in plural levels.

In the following explained still another embodiment of the present invention.

When the main heater alone is energized for the 21st and subsequent sheets as explained in the foregoing, the temperature of the end portions of the fixing roller becomes lower with the increase in the number of continuously transported sheets, whereby the fixing ability becomes lower.

Although the image fixation can still be achieved on ordinary paper, it may not be achieved on papers of inferior surface characteristics. For improving the fixing ability in such case, the ratio of energization times of the main heater and the sub heater is returned to 4:1 after 70 A4-sized sheets transported longitudinally. Thereafter repeated is a cycle consisting of 20 copies with said state of energization of 4:1 and 50 copies with the main heater only. Such operation mode provides improved fixing ability.

The kind of the paper can be designated on the operation panel (not shown) of the apparatus. The foregoing embodiments employ two heaters, but the control of on/off timing of the present invention may also be applied to three or more heaters.

In the following explained is still another embodiment of the present invention, of which configuration is same as shown in FIG. 28 and heat distribution characteristics are same as shown in FIGS. 29 and 30. In the present embodiment, the recording sheet is transported always at the center as the basis of reference, regardless of the size thereof.

The on/off timings of two heaters 49, 50 of the present embodiment are controlled in the following manner.

In this embodiment, a small-sized sheet means B4 size or smaller, and a large-sized sheet means is B4 size or larger. The B4-sized sheet is longitudinally transported with the longer side positioned along the transporting direction.

In case of image formation on small-sized sheets, since the heat is taken away principally from the central portion of the fixing roller, the main heater 49 alone is energized while the sub heater 50 is turned off.

Figure 33:
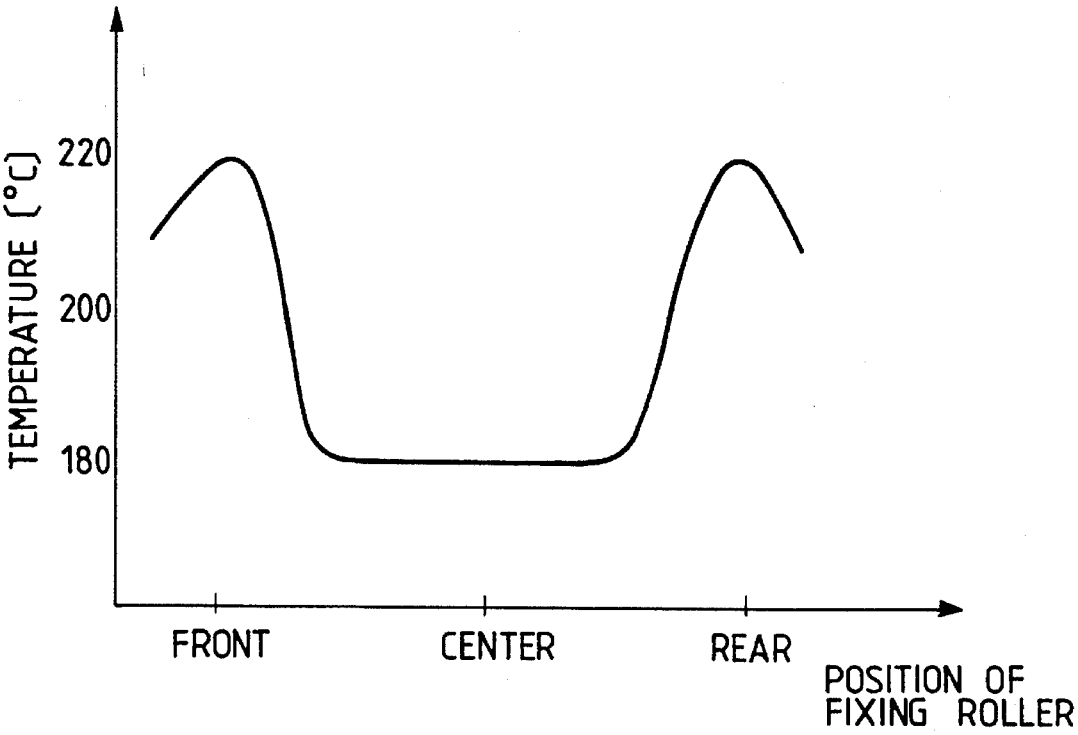
FIG. 33 is a chart showing temperature distribution of a fixing roller, after consecutive fixing of small-sized papers.

FIG. 33 shows the temperature distribution of the fixing roller after continuous fixation of small-sized sheets.

Even though the sub heater 50 is turned off, the temperature of the fixing roller becomes higher in the end portions after continuous fixing operations.

On the other hand, in case of image fixation on large-sized sheets, since heat is taken away also in the end portions of the fixing roller, the temperature of the end portions becomes lower and there will be encountered the defective fixation if the main heater alone is energized. Consequently the temperature distribution in the longitudinal direction of the fixing roller is made uniform by alternate energization of the sub heater and the main heater. In the present embodiment, a satisfactory temperature distribution could be obtained by a 4:1 ratio of energization times of the main heater and the sub heater. More specifically, while a heater energization signal is supplied from the control circuit 13, the main heater is turned on for 0.4 seconds and the sub heater is thereafter turned on for 0.1 seconds, in a cycle time of 0.5 seconds.

Figure 34:
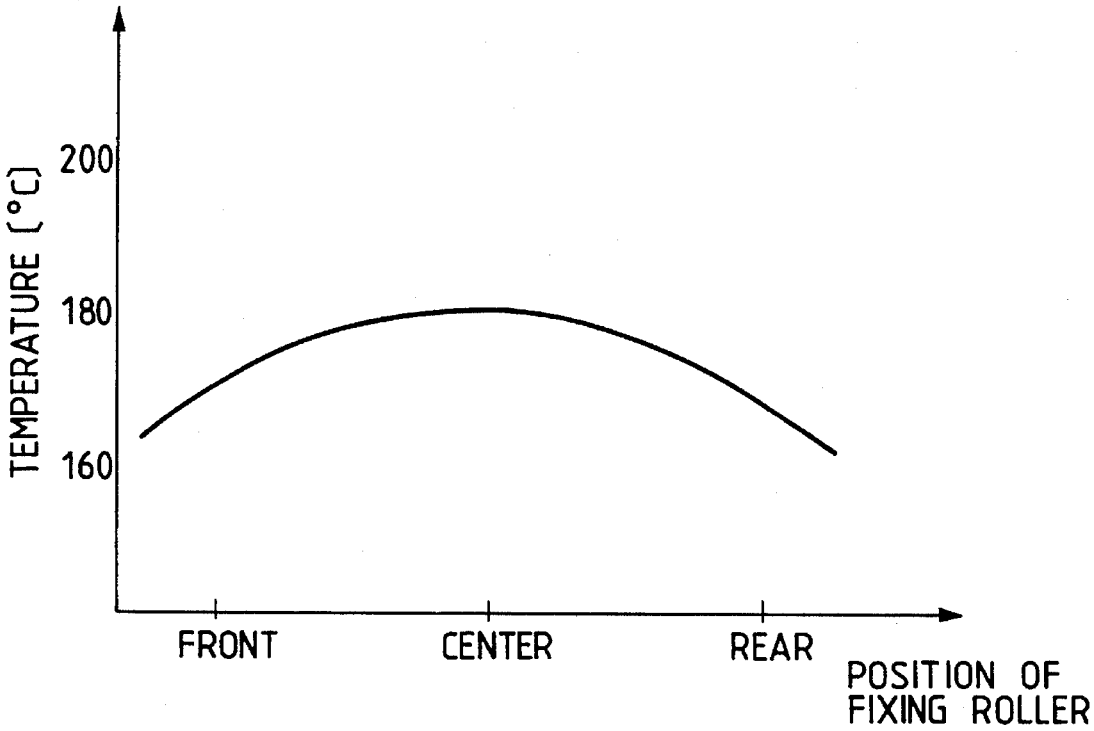
FIG. 34 is a chart showing temperature distribution of a fixing roller, after consecutive fixing of large-sized papers.

FIG. 34 shows the temperature distribution of the fixing roller, after continuous fixation of large-sized sheets.

In the following there will be explained the temperature control of the fixing roller in a stand-by state after the image fixation operation.

After continuous copying with the small-sized sheets, the fixing roller shows a higher temperature at the end portions, as shown in FIG. 33. Consequently, the temperature at the end portions cannot be easily lowered if the sub heater with the heat distribution higher in the end portions than in the central portion is employed in the temperature control during the stand-by state after the continuous fixation of small-sized sheets.

Consequently, in the present embodiment, in an initial stage of the stand-by state after the fixation of small-sized sheets, the temperature control is executed by the main heater which has the higher heat distribution in the central portion than in the end portions.

Thus, upon entering the stand-by state, the temperature of the end portions is promptly lowered, and uniform temperature distribution is realized on the fixing roller.

However, if the temperature control is continued with the main heater only even after the uniform temperature distribution is attained, the temperature of the end portions becomes lower due to the larger heat radiation in the end portions, thus eventually leading to defective fixation in said end portions.

For this reason, in the present embodiment, the temperature of the fixing roller is controlled by the main heater only for a predetermined initial period of the stand-by state required for obtaining uniform temperature distribution, and is thereafter controlled by the sub heater only.

After the continuous fixation of small-sized sheets, substantially uniform temperature distribution can be obtained on the fixing roller within about 1 minute by the temperature control with the main heater only.

In the present embodiment, therefore, the temperature control after continuous fixation of small-sized sheets is conducted by the main heater only for one minute and is thereafter conducted by the sub heater only.

The temperature control after continuous fixation of large-sized sheets is conducted in the following manner.

The temperature distribution of the fixing roller after such continuous fixation of the large-sized sheets is, as shown in FIG. 34, is higher in the central portion than in the end portions.

Therefore, in the stand-by stage after the continuous fixation of the large-sized sheets, the temperature control is conducted by the sub heater only whereby the temperature at the end portions is promptly raised to attain uniform temperature distribution over the fixing roller. After such uniform temperature distribution is attained, the temperature control is continued by the sub heater only to maintain the distribution, as the fixing roller shows larger heat radiation at the end portions.

As explained in the foregoing, the present embodiment allows to obtain substantially uniform temperature distribution over the fixing roller promptly after the end of fixing operation, independently from the energizing conditions for the heaters in the fixing operation, thereby preventing the high temperature offsetting and the thermal deterioration of the pressure roller and the cleaning member.

In the following explained is still another embodiment which employs a sub heater, having larger heat distribution in the end portions than in the central portion, of a larger power than that of the main heater having larger heat distribution in the central portion than in the end portions.

After continuous fixation of large-sized sheets, the temperature distribution of the fixing roller is higher, as shown in FIG. 34, in the central portion than in the end portions.

Figure 35:
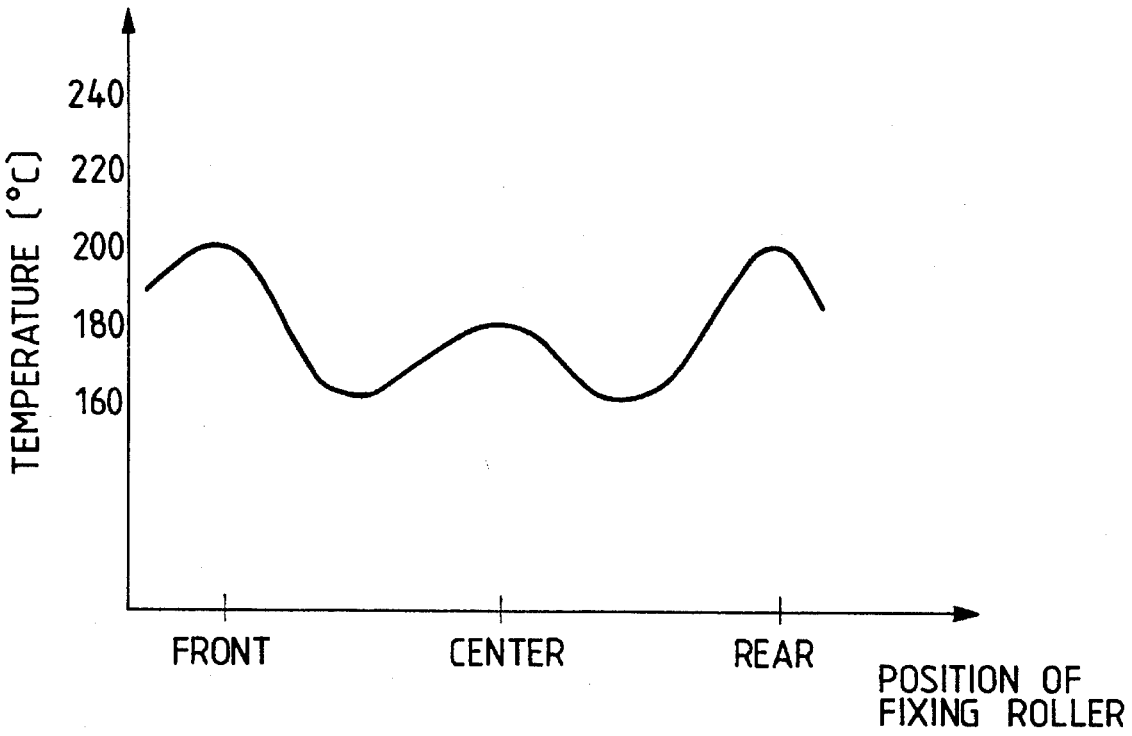
FIG. 35 is a chart showing temperature distribution of a fixing roller, in another embodiment.

If the temperature control after the continuous fixation of the large-sized sheet is conducted solely by the sub heater as in the foregoing embodiment, there will result portions of a lower temperature between the central and end portions as shown in FIG. 35, because the end portions show rapid temperature rise by the large-powered sub heater. If the fixing operation is conducted in such state, there will be encountered defective fixation in the portions of lower temperature. For this reason, the temperature control in this case is conducted by the sub heater only for a predetermined period after the continuous fixation, then by the main heater only, and again by the sub heater only.

Figure 36:
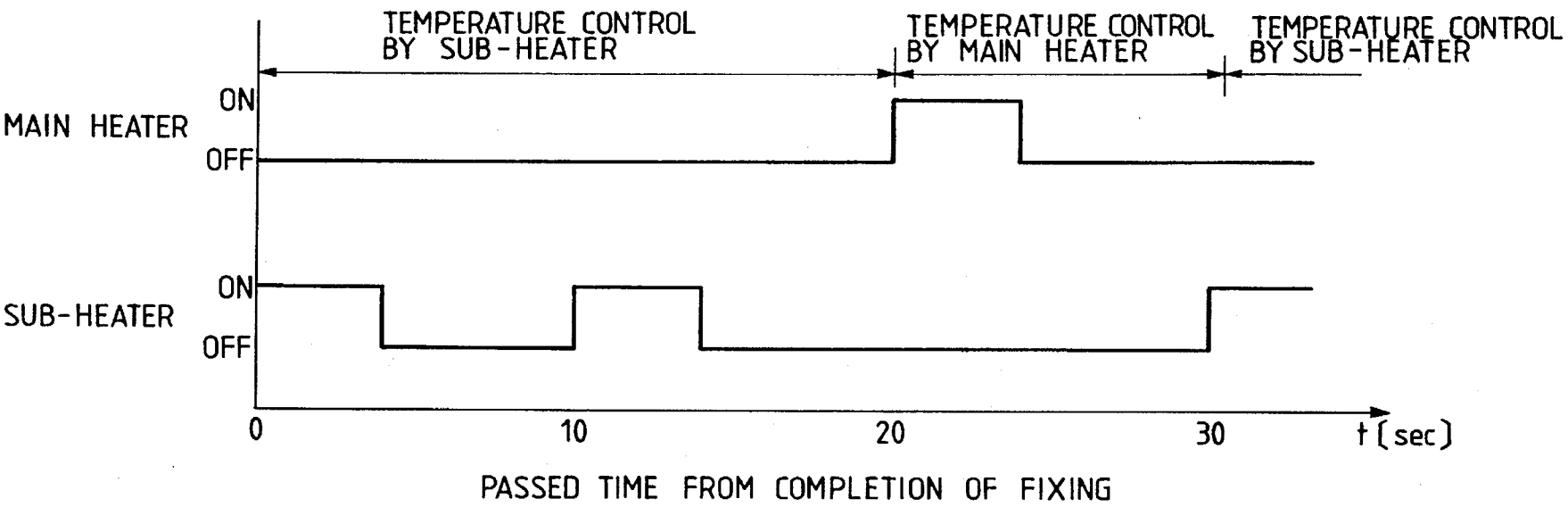
FIGS. 36 and 37 are charts showing the energized states of main and sub heaters.

More specifically, after the continuous fixation, the temperature control is conducted by the sub heater only for 20 seconds, then by the main heater only for 10 seconds, and thereafter by the sub heater only for 30 seconds, whereby a substantially uniform temperature distribution can be attained. FIG. 36 shows the on/off timings of the main and sub heaters during 30 seconds. It is thus possible to obtain a substantially uniform temperature distribution on the fixing roller and to prevent the defective fixation, by effecting the temperature control alternately with the main and sub heaters for a predetermined period, for example 1 minute, after the continuous copying operation.

Also, with the powers of the heaters and with the temperature distribution on the fixing roller after the fixing operation the same as those explained above, there will be encountered the defective fixation because of the portions of a lower temperature, if the temperature control is conducted by the sub heater only.

In this embodiment, therefore, the temperature control is conducted by alternately turning on and off the main and sub heaters for a predetermined period after the fixing operation.

Figure 37:
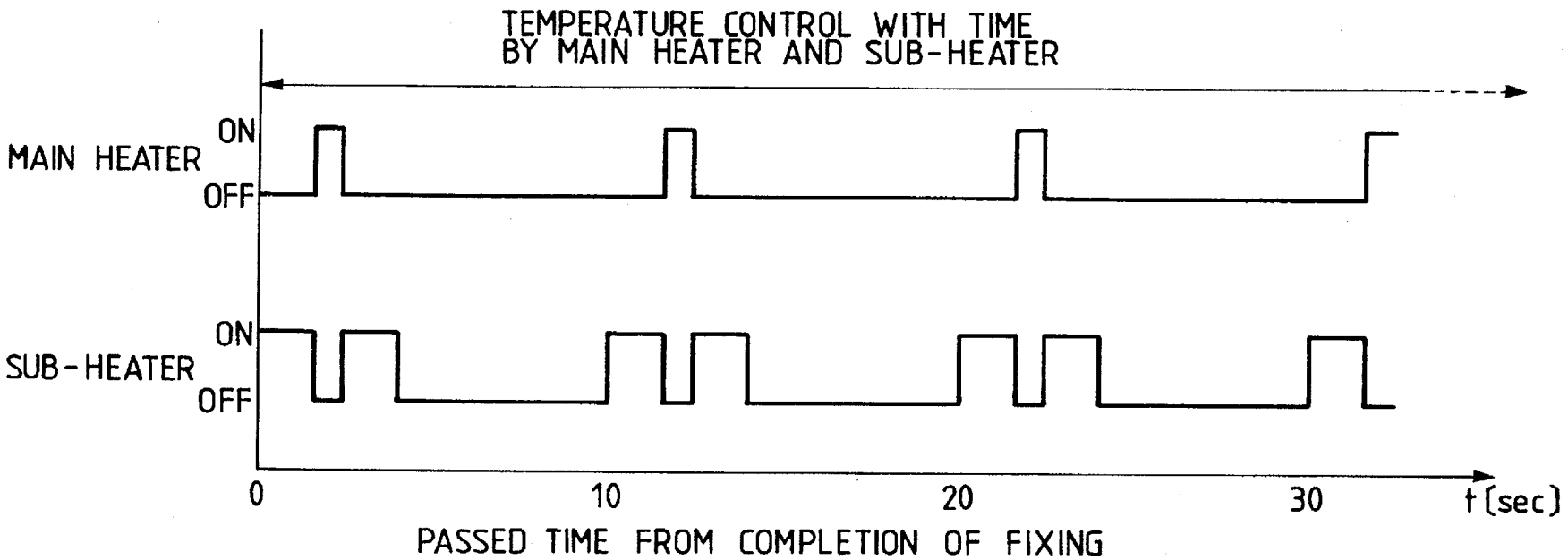

More specifically, it is possible to obtain a substantially uniform temperature distribution over the fixing roller and to prevent the defective fixation, by adopting 1:5 ratio in the energization times of the main and sub heaters and effecting such alternate energizations for 1 minute after the fixation. FIG. 37 shows the on/off timings of the main and sub heaters in the temperature control for 30 seconds. The temperature control is executed by a cycle time of 4 seconds.

In the following explained is still another embodiment of the present invention, of which configuration is same as that shown in FIG. 28, and of which the heat distributions of the heaters are same as those shown in FIGS. 29 and 30.

The fixing roller 45 is composed of a carbon steel cylinder 47 of a thickness of 0.7 mm and a releasing layer 48 of fluorinated resin coated thereon. The fixing roller 45 is provided therein with two halogen heaters 49, 50 of mutually different heat distributions.

The pressure roller 46 is composed of a core member 51, a silicone sponge rubber layer 52 provided thereon, and a releasing layer 53 of fluorinated resin, such as PFA, coated thereon.

Though carbon steel has sufficient strength, it is smaller in heat capacity than aluminum of a same amount, and is significantly inferior in thermal conductivity to aluminum. For this reason the fixing roller of carbon steel is inferior in the fixing ability to that of aluminum, and shows a larger temperature rise in the portions, where the recording sheets do not pass, than in the fixing roller made of aluminum. However, carbon steel is advantageous for reducing the waiting time by forming a thinner roller and for preventing the deformation by the pressure of the pressure roller, since the roller made of aluminum cannot provide enough strength for such purposes.

In case of fixing small-sized sheets, the main heater alone is energized while the sub heater is turned off.

Figure 38:
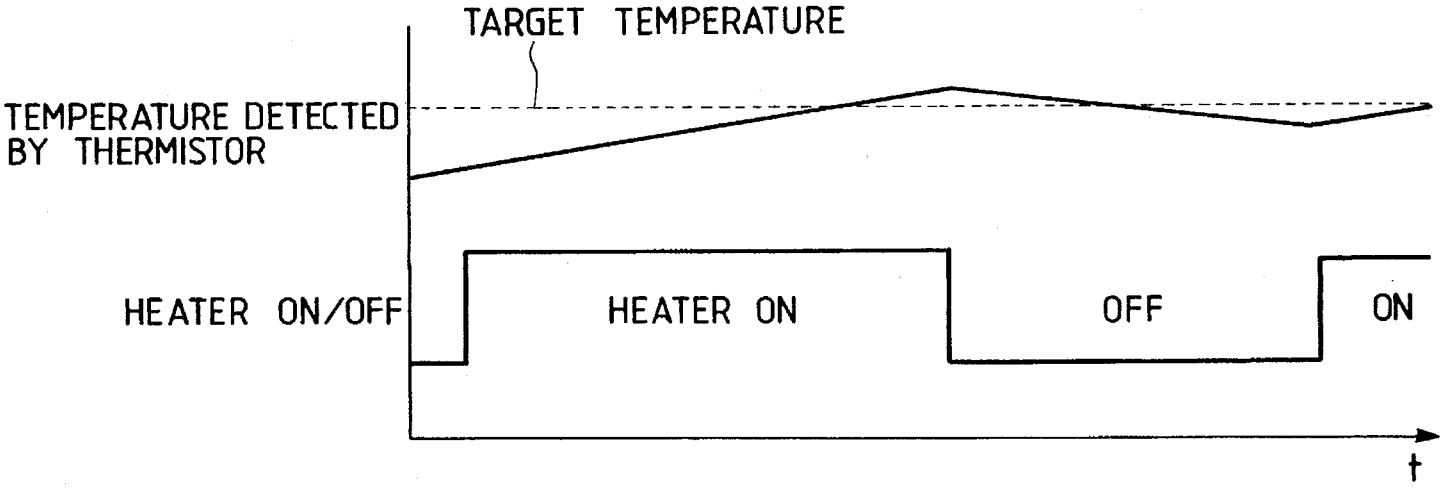
FIG. 38 is a chart showing the on/off timings in case of a single heater.
Figure 39:
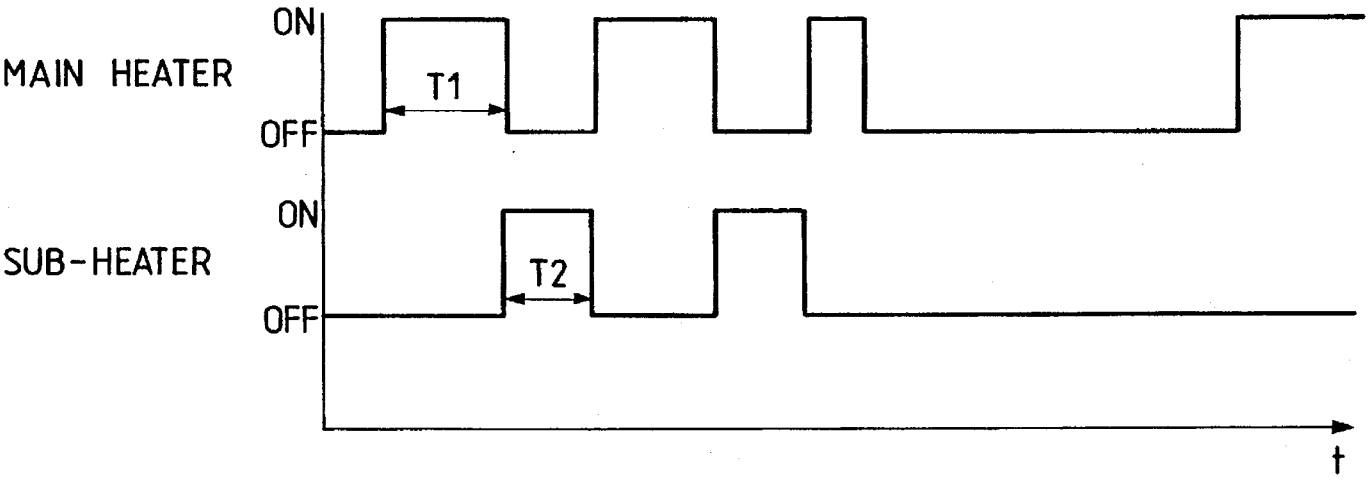
FIG. 39 is a chart showing the on/off timings of heaters embodying the present invention.
Figure 40:
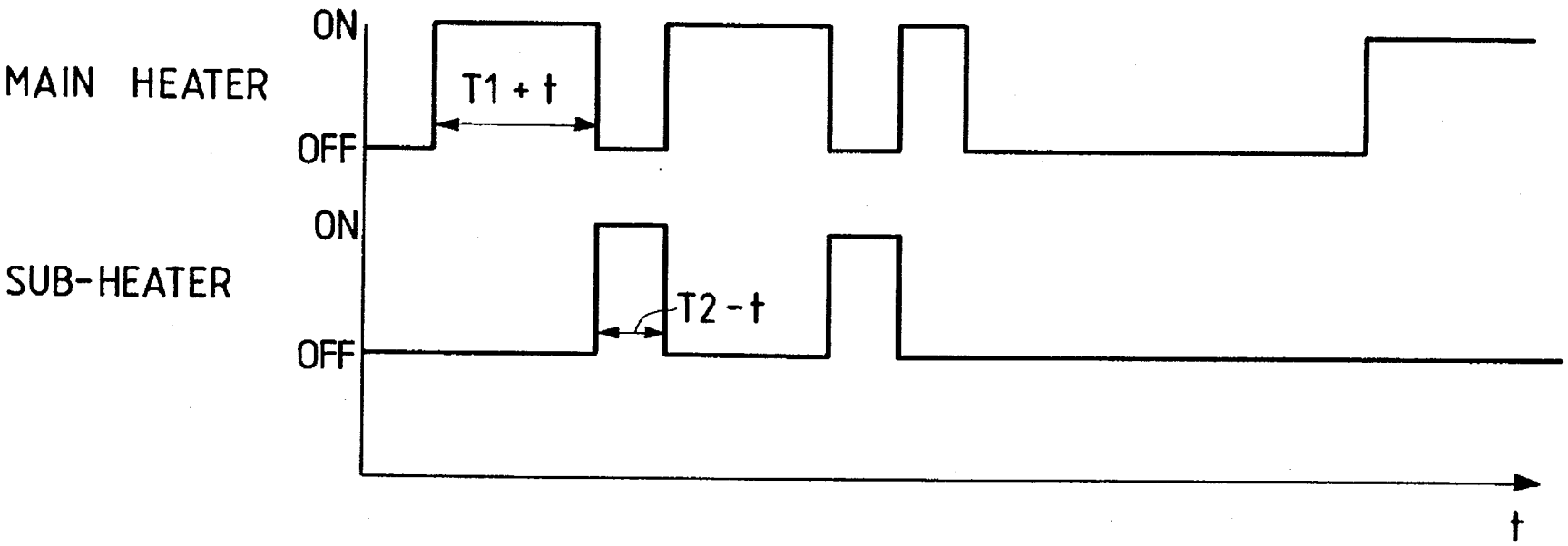
FIG. 40 is a chart showing the on/off timings of heaters embodying the present invention.

In case of fixing large-sized sheets, the two heaters are alternately energized, with a controlled time ratio, as will be explained in the following with reference to FIGS. 38 to 40. The control device is provided with a mechanism for individually turning on and off the main and sub heaters, and, instead of the conventional temperature control by the on/off operations of a single heater as shown in FIG. 38, energizes the main heater for T1 seconds and the sub heater for T2 seconds alternately as shown in FIG. 39, thereby achieving satisfactory fixation even on the sheet of maximum width. It is also possible to satisfactorily fix the sheets of another size, for example B4 size, by modifying the time ratio of energizations of the heaters, for example by energizing the main heater for T1−t seconds and the sub heater for T2+t seconds in alternate manner.

The above-explained fixing device was incorporated and tested in a copying machine of 30 cpm. The temperature was usually controlled at 190° C. but was reduced by 10° C. after 60 small-sized sheets of which width did not exceed the transversal width of A4 size. The maximum sheet width was the transversal width of A3 size. For a sheet width exceeding the transversal width of A4 size, the time ratio T1:T2 of energizations of the main and sub heaters was selected as 4:1, in order to supply, by the sub heater, the deficient heat at the end portions of the main heater.

The on/off timings were selected as shown in Table 2, depending on the sheet size and the number of passed sheets.

TABLE 2

| Sheet width | A3R/A4 | B4R | A4R |
|---|---|---|---|
| Main: Sub energization time ratio | 4:1 | 8:1 | Sub heater only |
| Controlled temperature | 190° C. | 190° C. −10° C. for 60th sheet and thereafter | 190° C. −10° C. for 60th sheet and thereafter −20° C. for 140th sheet and thereafter |

The fixing conditions in the preceding copying operation are memorized in a memory of the control circuit 33 for 1 minute after the termination of the preceding copying operation.

In the present embodiment, if a next copying operation is started within one minute after the termination of the preceding copying operation, the temperature control and the time ratio of energization of two heaters are varied as a continuation of the preceding fixing operation. For example, in a state with significant temperature rise in the end portions after the passing of a large amount of A4R-sized sheets, if B4R-sized sheets are passed with the energization of the sub heater, the end portions will require a long time for returning to the normal temperature state. For this reason, when the B4R-sized sheets are passed after the passing of a certain number of the A4R-sized sheets, the fixation is executed by the main heater only for an initial period. Satisfactory fixation can be attained solely by the main heater in such initial period because of the higher temperature at the end portions.

After the lapse of 1 minute from the termination of the preceding copying operation, the preceding fixing conditions are reset from the memory, and the fixing conditions for a new copying operation are selected depending on the sheet width and the number of sheets in the new copying operation.

Following Table 3 shows the fixing conditions to be selected when a new copying operation is initiated within 1 minute after the termination of the preceding copying operation.

TABLE 3

| | A3R/A4 | B4R | A4R |
|---|---|---|---|
| A3R/A4 (max. sheet width) 0– | 190° C. 4:1 | 190° C. −10° C. for 60th sheet & thereafter 8:1 | 190° C. −10° C. for 60th sheet & thereafter −20° C. for 140th sheet & thereafter main heater only |
| B4R 0–60 | 190° C. 4:1 | 190° C., cumulative sheet number −10° C. for 60th sheet & thereafter 8:1 | 190° C., cumulative sheet number −10° C. for 60th sheet & thereafter −20° C. for 140th sheet & thereafter main heater only |
| B4R 60– | 190° C. 4:1 | 180° C., cumulative sheet number 8:1 | 190° C., cumulative sheet number −20° C. for 140th sheet & thereafter main heater only |
| A4R | 190° C. | 190° C., cumulative | 190° C., cumulative |

TABLE 3-continued

| | A3R/A4 | B4R | A4R |
|---|---|---|---|
| 0–60 | main heater only up to 10th sheet 4:1 for 11th sheet & thereafter | sheet number main heater only up to 10th sheet 8:1 for 11th sheet & thereafter | sheet number −10° C. for 60th sheet & thereafter −20° C. for 140th sheet & thereafter main heater only |
| A4R 60–140 | 190° C. main heater only up to 10th sheet 4:1 for 11th sheet & thereafter | 180° C., cumulative sheet number main heater only up to 10th sheet 8:1 for 11th sheet & thereafter | 180° C., cumulative sheet number −20° C. for 140th sheet & thereafter main heater only |
| A4R 140– | 190° C. main heater only up to 10th sheet 4:1 for 11th sheet & thereafter | 180° C., cumulative sheet number main heater only up to 10th sheet 8:1 for 11th sheet & thereafter | 170° C., cumulative sheet number main heater only |

In Table 3, the vertical column indicates the sheet size and the number of passed sheets in the preceding copying operation. The horizontal row indicates the sheet size of a new copying operation, initiated within one minute after the termination of the preceding copying operation. The "cumulative sheet number" in the table indicates that the number of sheets in the new copying operation has to be added to the number of the sheets in the preceding copying operation.

As an example, let us consider a case of passing 80 A4R-sized sheets and, within one minute thereafter, 20 B4R-sized sheets. The temperature is controlled to 180° C. by the first sheet passing. In the second sheet passing, the temperature control is conducted as shown in a box at the crossing of the horizontal row for "A4R, 60–140" and the vertical column for "B4R". Thus the temperature is controlled at 180° C., and the sheet number is counted from 81st. Consequently the temperature is controlled by the main heater only up to the 10th B4R-sized sheet. For the 11th sheet and thereafter, the temperature is controlled with the main and sub heaters with a time ratio of 8:1.

The foregoing two tables are stored as look-up tables, and are referred to for determining the controlled temperature in case a new copying operation is to be started within one minute from the termination of the preceding copying operation.

Figure 41:
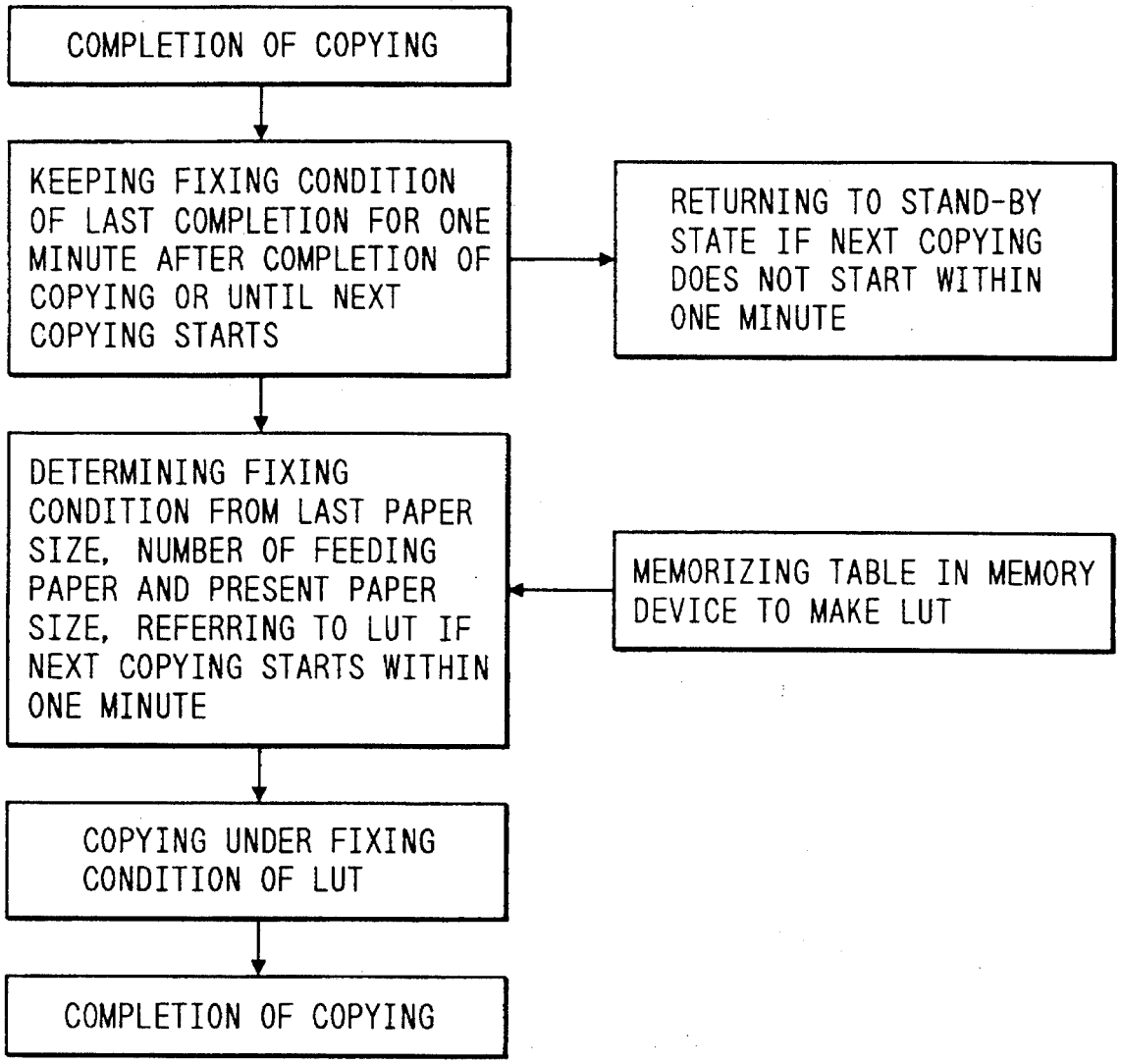
FIGS. 41 and 42 are flow charts of the control sequence of embodiments of the present invention.

FIG. 41 shows the control sequence of the present embodiment, which can prevent the temperature rise in the portions of the fixing roller where the recording sheet do not pass, and the defective fixation, under any conditions.

In the following explained is still another embodiment, which is provided with a mechanism for controlling, in addition to the fixing conditions, the sheet passing speed and/or the pre-rotation time prior to the copying operation.

In case the small-sized sheets are to be passed within a predetermined time in a state with significant temperature rise in the end portions as a result of passing of a large amount of small-sized sheets, the pre-rotation time is extended to sufficiently lower the temperature of said end portions, prior to the next sheet passing. It is also possible to low the temperature of the end portions by reducing the sheet passing speed or by extending the interval of sheets in the initial stage only of the next copying operation.

The condition setting in the present embodiment is shown in Table 4.

TABLE 4

| | Control |
|---|---|
| A4R, 0–60 | None |
| A4R, 61–140 | Extend pre-rotation by 5 seconds; or extend sheet interval by 5 cm; or reduce sheet passing speed by 5% |
| A4R, 141– | Extend pre-rotation by 10 seconds; or extend sheet interval by 10 cm; or reduce sheet passing speed by 10% |

In Table 4, the "A4R" indicates the sheet size in the preceding copying operation, and the attached number indicates the number of sheets passing in said operation. The sheet size in the second copying operation is also assumed to be A4R size. The control shown in this table is naturally not conducted after the lapse of a predetermined time from the termination of the preceding copying operation.

In the following explained is still another embodiment, which employs so-called forced energization, for a predetermined period from the copying start signal, for example unit the first sheet passes the fixing device and then returns the fixing temperature to the normal condition, thereby ensuring the fixation for the first sheet at the start of fixing operation.

Figure 42:
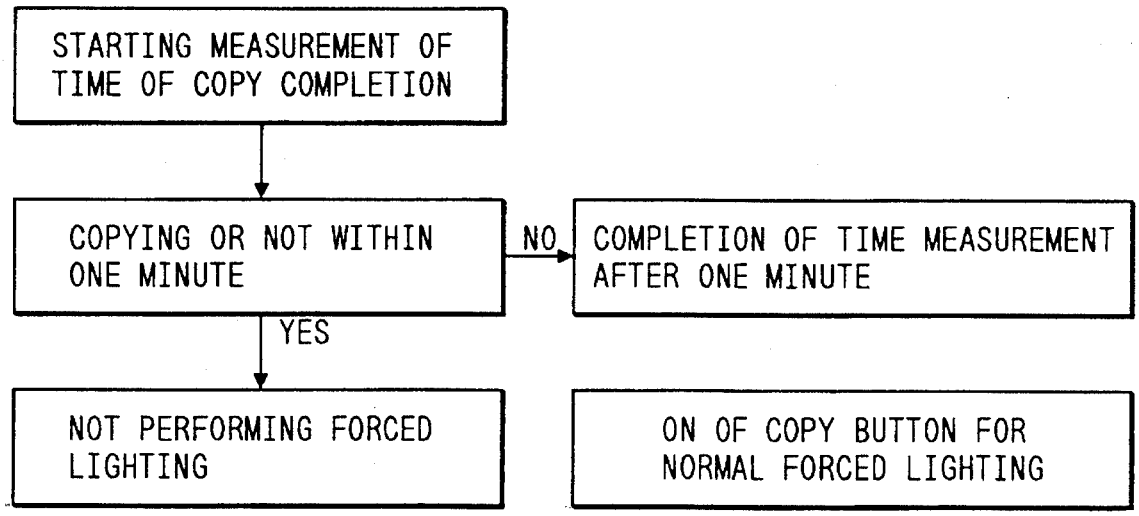
Figure 43:
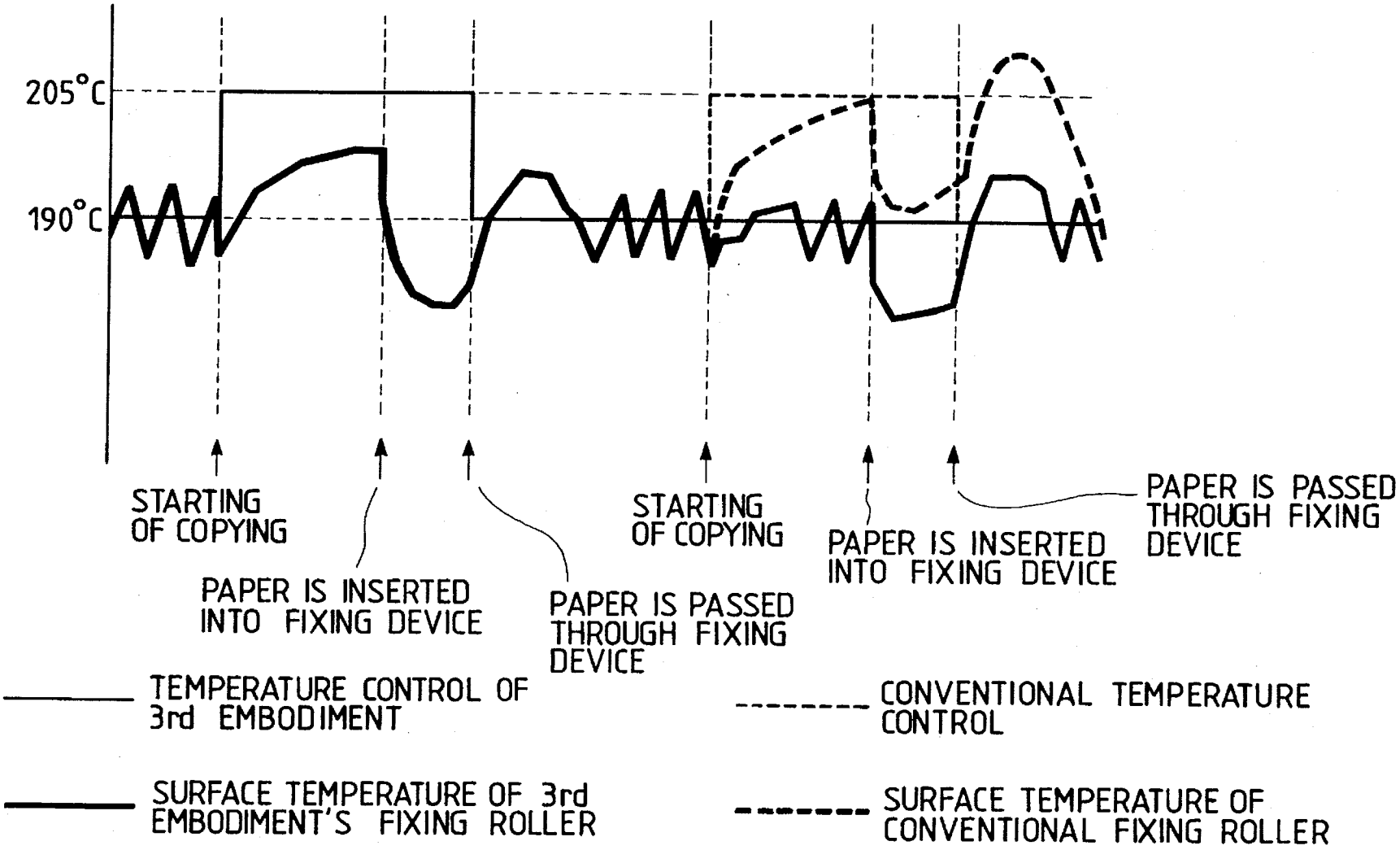
FIGS. 43 and 44 are charts showing temperature change in the fixing roller in embodiments of the present invention.
Figure 44:
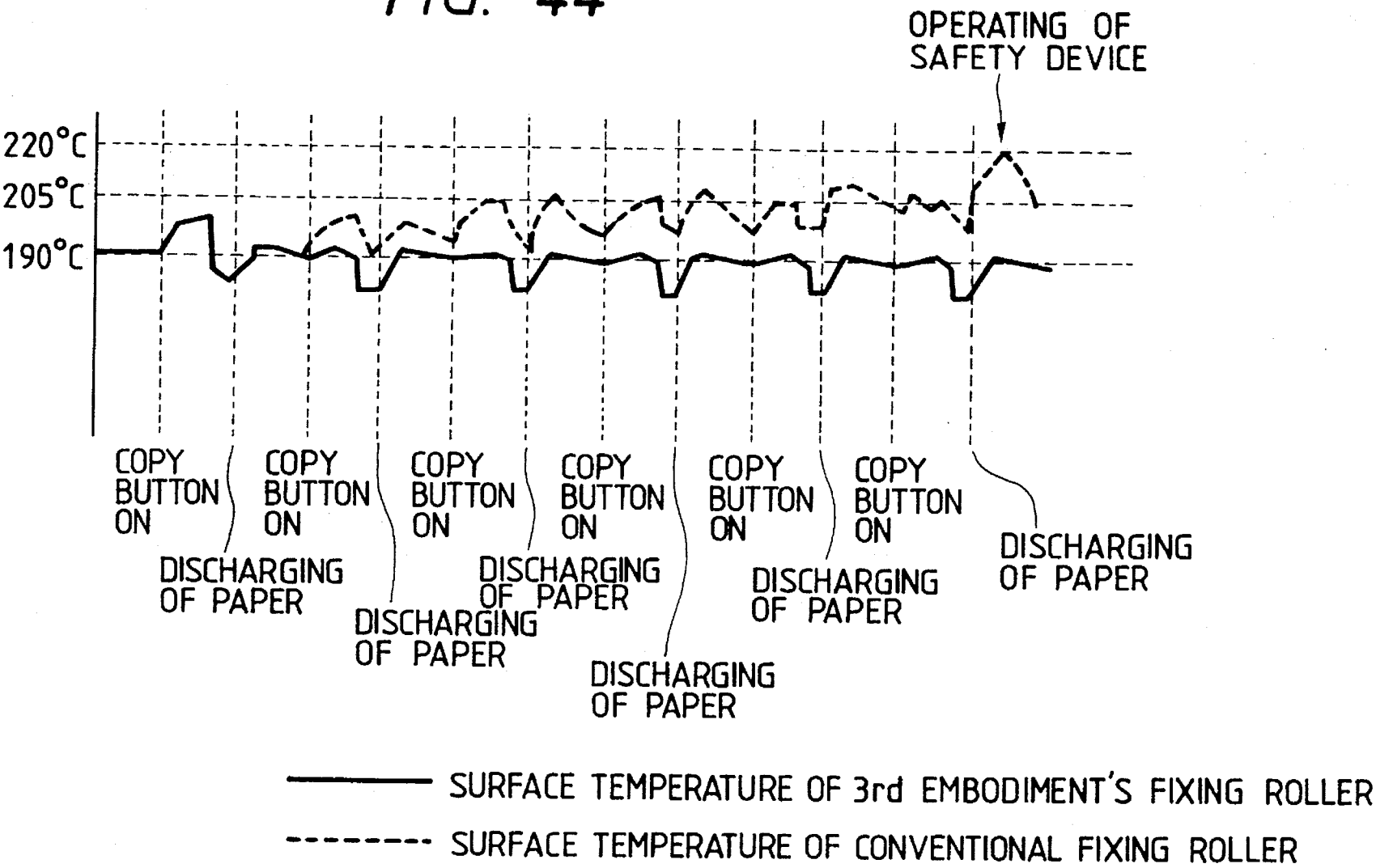

FIG. 42 shows the control sequence of the present embodiment, and FIGS. 43 and 44 show the temperature change on the fixing roller.

The fixing device of the present embodiment was tested on a copying machine of 30 cmp shown in FIG. 27. The forced energization was conducted to control the temperature at 205° C. from the start of copying operation to the passing of the first sheet through the fixing device, and the temperature control was thereafter returned to the normal value of 190° C.

The fixing device of the conventional control, in a copying operation with a sheet interval of 1 second, showed the surface temperature of the fixing roller of 205° C., but the safety device was activated as the surface temperature temporarily reached 220° C. at maximum.

In this copying machine, the forced energization was dispensed with when a new copying operation was started within one minute after the termination of the preceding copying operation. With a sheet interval of 1 second, the fixing device showed the surface temperature of 190° C., with a maximum temperature of 200° C. which was acceptable. Also the fixing ability was satisfactory.

Figure 45:
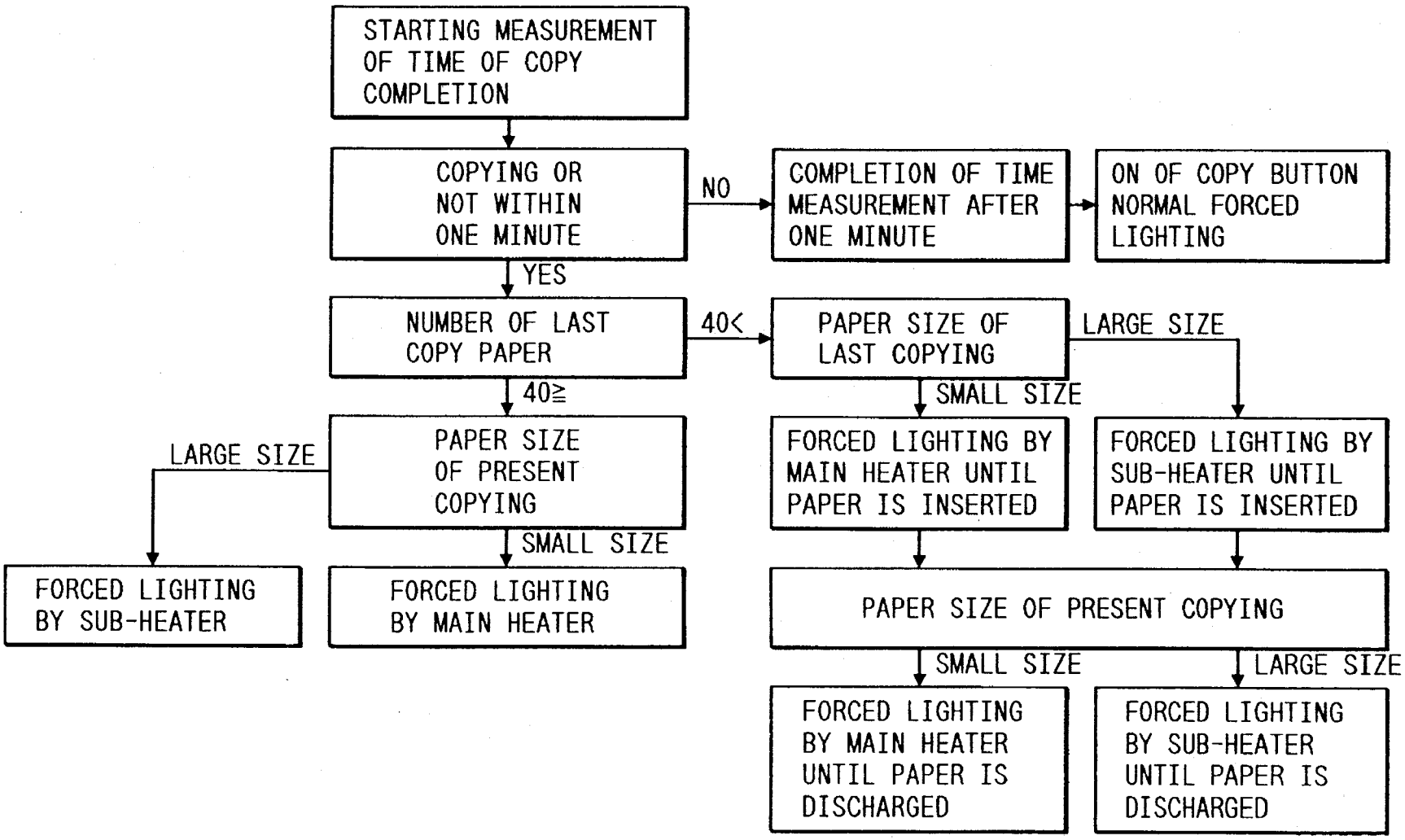
FIG. 45 is a flow chart showing the control sequence of an embodiment of the present invention.

FIG. 45 is a flow chart of the control sequence of still another embodiment, of which configuration of the apparatus is same as that of the foregoing embodiment and will not, therefore, be explained further.

This embodiment employs two halogen heaters of mutually different heat distributions. The heat distributions and powers of the two halogen heaters are same as those shown in FIGS. 7 and 8.

At the end of a copying operation, the time measurement is started, but is terminated unless a new copying operation is started within a minute. A copying operation started thereafter is conducted in the normal manner.

If a new copying operation is started within the one minute, the number of sheets passed in the preceding copying operation is identified, because an uneven temperature distribution has been developed if a large number of sheets are passed in the preceding operation. In this embodiment, such uneven temperature distribution is considered absent if the number of sheets passed in the preceding copying operation does not exceed 40.

In such case the conditions in the preceding copying operation are disregarded, and the halogen heaters to be employed in the forced energization are determined according to the sheet size to be employed in the new copying operation.

More specifically, if the maximum (large) sheet size is to be employed in the new copying operation, the forced energization is conducted by the sub heater only, in order to compensate the temperature loss in the end portions, resulting from the passing of large-sized sheets. If the sheets to be passed are narrower than the maximum sheet size, the forced energization is conducted by the main heater only, in order to suppress the temperature rise in the end portions. In both cases, after the forced energization, the fixing operation is conducted with a suitable energization ratio for the heaters, matching the sheet size. Naturally the forced energization need not be classified into the large and small sheet sizes but may be conducted for various sheet sizes, by suitably modifying the energization ratio of the heaters. Also the number of heaters is not limited to two.

If the number of copies in the preceding copying operation exceeds 40, the heaters to be employed in the forced energization, until the first sheet enters the fixing device, are determined according to the sheet size in said preceding copying operation.

If the large-sized sheets are used in the preceding operation, the forced energization is conducted by the sub heater only, because the temperature in the end portions has become lower. If the small-sized sheets are used in the preceding operation, the forced energization is conducted by the main heater only, in order to reduce the temperature in the end portions. Then the heater to be employed in the forced energization from the entry of the first sheet into the fixing device to the discharge therefrom is determined according to the sheet size employed in the new copying operation. If the large-sized sheets are employed in the new operation, the forced energization is conducted by the sub heater only, in order to compensate the temperature loss in the end portions resulting from the passing of the large-sized sheets. If the small-sized sheets are employed in the new operation, the forced energization is conducted by the main heater only, in order to reduce the temperature rise in the end portions. Also in this case, after the forced energization, the fixing operation is conducted with a suitable energization ratio of the heaters, matching the sheet size. In the present embodiment, the mode of forced energization is switched when the sheet enters the fixing device, but the timing of the switching may be varied for individual device. It is naturally possible also to continuously vary the energization ratio of the heaters.

This embodiment enables satisfactory fixation, regardless of the sheet sizes and the sheet numbers in the preceding and new copying operation.

Figure 46:
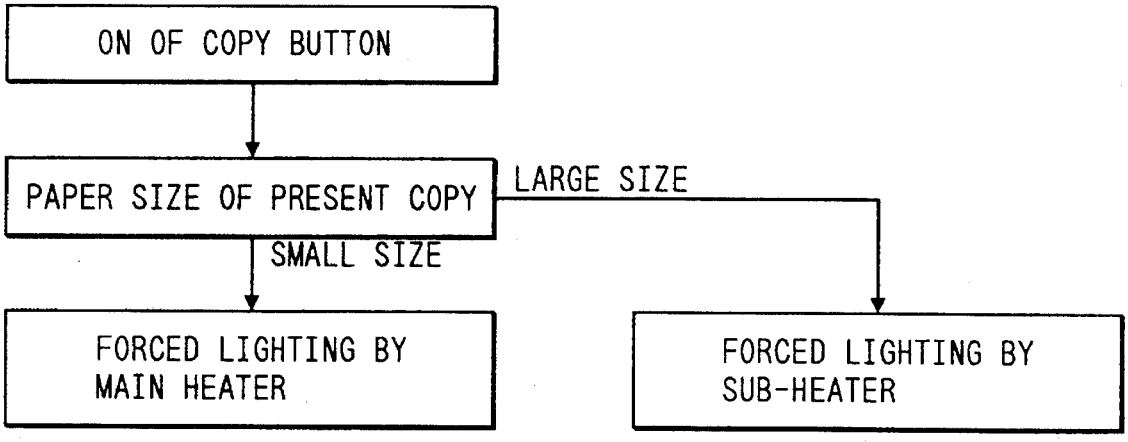
FIG. 46 is a flow chart showing the control sequence of an embodiment of the present invention.

FIG. 46 is a flow chart of the control sequence of still another embodiment, which is also adapted for use in a copying machine capable of varying the energization ratio of the main and sub heaters, as in the first embodiment.

In this embodiment, when the copy start button is depressed, the forced energization by the main or sub heater is determined according to the sheet size to be employed in the copying operation.

If the large-sized sheets are to be used in the copying operation, the forced energization is conducted with the sub heater, in order to compensate the temperature loss in the end portions, resulting from heat radiation in the end portions. If the small-sized sheets are to be used in the copying operation, the forced energization is conducted with the main heater, in order to alleviate the temperature rise in the end portions. Also in this case it is naturally possible to classify the sheet size into more than two sizes and to modify the energization ratio of the heaters so as to realize optimum temperature distributions respectively matching said sheet sizes. Also the number of the heaters is not limited to two.

After forced energization, the fixing operation is conducted with an optimum energization ratio matching the sheet size.

Also the present embodiment provides satisfactory fixing performance, even from the first copy after a prolonged standing time. The force energization can be conducted with improved efficiency, because the heater is selected according to the sheet size.

The foregoing embodiments have been explained by the fixing device employing the heating roller, but the present invention is likewise applicable to other image heating devices of contact type.

The present invention is not limited by the foregoing embodiments but is subjected to any modifications within the scope and spirit of the appended claims.

What is claimed is:

1. An image heating device comprising:

a heating member including a first heater and a second heater of a heat distribution different from that of said first heater;

a back-up member forming a nip with said heating member; and power supply control means for time-shared controlling of electric power supply to said first and second heaters, wherein said power supply control means is adapted to control a time-shared ratio of energization time of said first heater to said second heater in accordance with a number of image heating operations.

2. An image heating device according to claim 1, wherein the heat distribution of said first heater substantially corresponds to a recording member of a small size, and the heat distribution of said second heater substantially corresponds to a portion along said heating member where said recording member of small size does not pass.

3. An image heating device according to claim 1, wherein said first heater has the heat distribution which is higher in a central portion than in its end portions, and said second heater has the heat distribution which is higher in the end portions than in the central portion.

4. An image heating device according to claim 1, wherein said power supply control means is adapted to control the energization time of said first and second heaters according to a size of the recording member.

5. An image heating device according to claim 1, wherein said power supply control means is adapted to vary the energization time of said first and second heaters between a a condition when the recording member passes through the nip and a condition when the recording member does not pass through the nip.

6. An image heating device according to claim 1, further comprising a temperature detecting member for detecting the temperature of a portion of said heating member where the recording member does not pass, wherein said power supply control means is adapted to control the energization time of said first and second heaters according to the temperature detected by said temperature detecting member.

7. An image heating device according to claim 1, wherein said power supply control means is adapted to control the energization time of said first and second heaters after termination of image heating according to conditions of said image heating.

8. An image heating device according to claim 1, wherein said power supply control means is further adapted to control the energization time of said first and second heaters according to a size of a recording material in a preceding image heating operation.

9. An image heating device comprising:

a heating member including a first heater and a second heater;

a back-up member forming a nip with said heating member; and power supply control means for effecting time-shared control of supplying electric power to said first and second heaters, wherein recording members pass through the nip uniformly displaced from a feeding reference, and wherein said first heater has a higher heat distribution in areas near the feeding reference than in areas away from the feeding reference, and said second heater has a lower heat distribution in areas near the feeding reference than in areas away from the feeding reference.

10. An image heating device according to claim 9, wherein the heat distribution of said first heater substantially corresponds to a recording member of a small size, and the heat distribution of said second heater substantially corresponds to a portion along said heating member where said recording member of small size does not pass.

11. An image heating device according to claim 9, wherein said power supply control means is adapted to control the energization time of said first and second heaters according to a size of a recording member.

12. An image heating device according to claim 9, wherein said power supply control means is adapted to vary the energization time of said first and second heaters between a condition when a recording member passes through the nip and a condition when a recording member does not pass through the nip.

13. An image heating device according to claim 9, further comprising a temperature detecting member for detecting the temperature of a portion of said heating member where the recording members do not pass, wherein said power supply control means is adapted to control the energization time of said first and second heaters according to the temperature detected by said temperature detecting member.

14. An image heating device according to claim 9, wherein said power supply control means is adapted to control the energization time of said first and second heaters according to the size and the continuously passed number of the recording members.

15. An image heating device according to claim 9, wherein said power supply control means is adapted to control the energization time of said first and second heaters after termination of image heating according to conditions of said image heating.

16. An image heating device according to claim 9, wherein said power supply control means is adapted to control the energization time of said first and second heaters in accordance with the size of the recording material in a preceding image heating operation and the number of image heating operations.

* * * * *

UNITED STATES PATENT AND TRADEMARK OFFICE

CERTIFICATE OF CORRECTION

PATENT NO. : 5,512,993
DATED : April 30, 1996
INVENTOR(S) : SAIJIRO ENDO, ET AL.

It is certified that error appears in the above-indentified patent and that said Letters Patent is hereby corrected as shown below:

Column 1, line 44, "rise"should read --rise to--.

Column 14, line 7, "is" should be deleted.

Signed and Sealed this

Twentieth Day of August, 1996

Bruce Lehman

*Attest:*

BRUCE LEHMAN

*Attesting Officer*

*Commissioner of Patents and Trademarks*